US008966769B1

(12) United States Patent
Mollick et al.

(10) Patent No.: US 8,966,769 B1
(45) Date of Patent: Mar. 3, 2015

(54) FOLDING KNIFE WITH BOLT LOCKING ASSEMBLY

(71) Applicants: Mark J. Mollick, Phoenix, AZ (US); Paul J. Mollick, Phoenix, AZ (US)

(72) Inventors: Mark J. Mollick, Phoenix, AZ (US); Paul J. Mollick, Phoenix, AZ (US)

( * ) Notice: Subject to any disclaimer, the term of this patent is extended or adjusted under 35 U.S.C. 154(b) by 162 days.

(21) Appl. No.: 13/627,909

(22) Filed: Sep. 26, 2012

(51) Int. Cl.
*B26B 1/04* (2006.01)

(52) U.S. Cl.
USPC ..... 30/161; 30/164

(58) Field of Classification Search
USPC ..... 30/153, 155, 157, 160, 161; 411/349, 411/549, 552, 338
See application file for complete search history.

(56) References Cited

U.S. PATENT DOCUMENTS

| | | | | |
|---|---|---|---|---|
| 943,990 | A | 12/1909 | Nell | |
| 969,909 | A | 9/1910 | Schrade | |
| 4,750,267 | A * | 6/1988 | Boyd | 30/161 |
| 5,699,615 | A | 12/1997 | Chen | |
| 5,839,194 | A | 11/1998 | Bezold | |
| 5,875,552 | A | 3/1999 | Chen | |
| 6,105,255 | A | 8/2000 | Cheng | |
| 6,276,063 | B1 | 8/2001 | Chen | |
| 6,276,247 | B1 | 8/2001 | Helda | |
| 6,418,626 | B1 | 7/2002 | Jang | |
| 6,434,831 | B2 | 8/2002 | Chen | |
| 6,729,029 | B1 | 5/2004 | Chu | |
| 6,991,414 | B1 * | 1/2006 | Mensah | 411/231 |
| 2005/0097755 | A1 | 5/2005 | Galyean et al. | |
| 2009/0277015 | A1 * | 11/2009 | Duey | 30/160 |

* cited by examiner

*Primary Examiner* — Kenneth E. Peterson
*Assistant Examiner* — Nhat Chieu Do
(74) *Attorney, Agent, or Firm* — Thomas W. Galvani, P.C.; Thomas W. Galvani

(57) ABSTRACT

A folding knife includes a handle assembly and a blade with a tang mounted to the handle assembly for pivotal movement of the blade between open and closed positions. The knife includes a bolt locking assembly carried in the handle assembly for movement between a locked configuration and an unlocked configuration. The bolt locking assembly includes first and second bolts. In the locked configuration of the bolt locking assembly, the first and second bolts are in an interference position with the tang so as to prevent pivotal movement of the blade.

20 Claims, 18 Drawing Sheets

FOLDING KNIFE WITH BOLT LOCKING ASSEMBLY

FIELD OF THE INVENTION

The present invention relates to knives and more particularly to safety mechanisms on folding knives.

BACKGROUND OF THE INVENTION

Knives are useful, everyday tools. Folding knives are knives with blades that pivot between an open position in which the blade is deployed for use and a closed position in which the blade is stored for non-use. Users generally desire that the blade remain in the open position when the knife is being used and that the blade remain in the closed position when the knife is not being used.

Various locking systems have been developed in the past to lock the blade in position. However, many of these locking arrangements are complex or subject to accidental release. Many are not aesthetically pleasing and can interfere with the use or storage of the knife. An improved safety mechanism for a folding knife is needed.

SUMMARY OF THE INVENTION

According to the principle of the invention, a folding knife includes a bolt locking assembly for locking and unlocking a knife blade having a tang. The bolt locking assembly includes first and second bolts carried for reciprocation in the knife. When the blade is open and the bolt locking assembly is in a locked configuration, lugs on the first and second bolts are in contact with tang, preventing pivotal movement of the blade. When the blade is closed and the bolt locking assembly is in the locked configuration, at least one of the lugs on the first and second bolts is in contact with the tang, preventing pivotal movement of the blade.

BRIEF DESCRIPTION OF THE DRAWINGS

Referring to the drawings:

FIGS. 24A-24C are section views taken along the line 24-24 in FIG. 23A, showing a sequence of steps of moving the cap assembly from the locked position to the operative position and depressing the bolt locking assembly;

FIG. 25 is an isolated, exploded perspective view of an alternate embodiment of a cap assembly.

DETAILED DESCRIPTION

Figure 1:
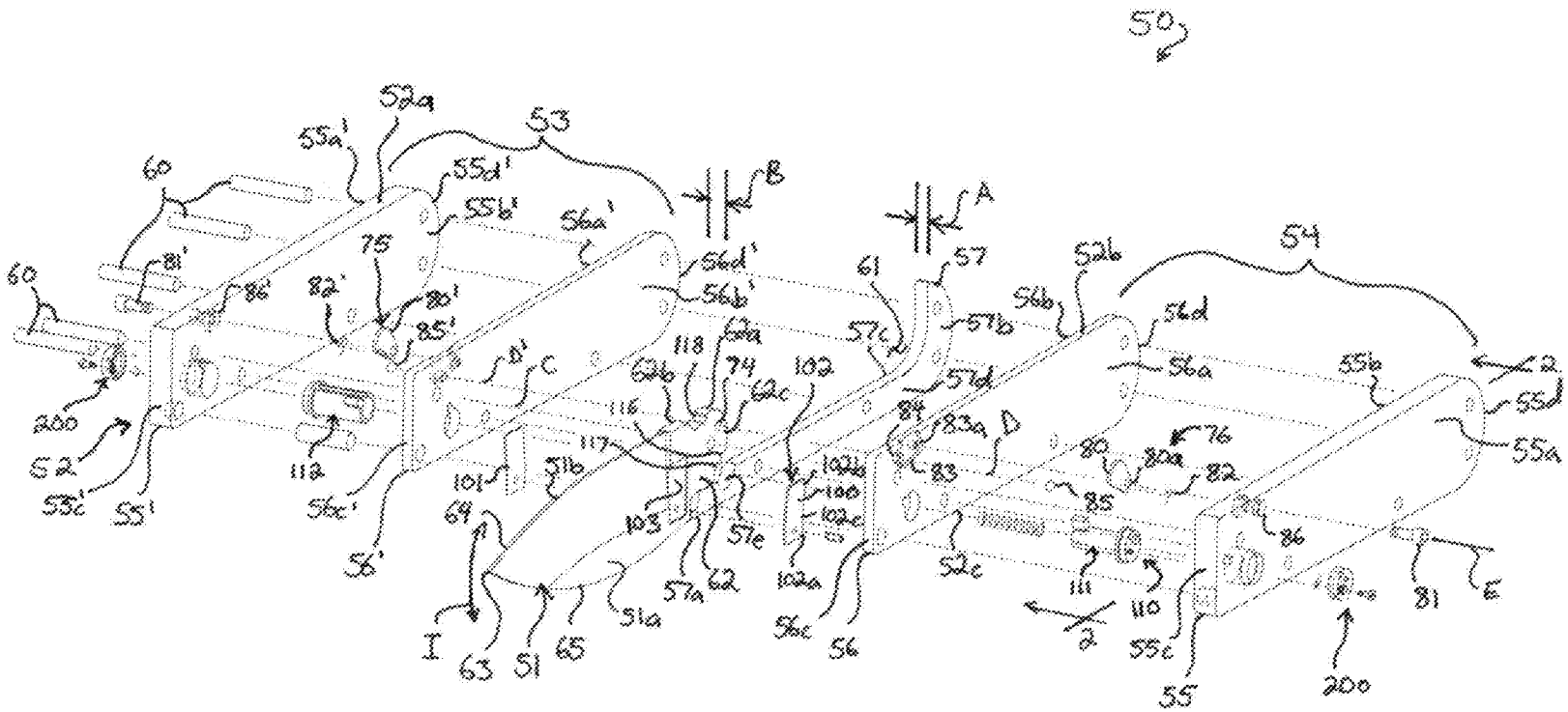
FIG. 1 is an exploded perspective view of an embodiment of a folding knife according to the principle of the invention, including a blade, a handle assembly, a grip locking assembly, bolt locking assembly, and locking member for locking the blade, and a cap assembly for preventing depression of the bolt locking assembly.

Reference is now made to the drawings, in which the same reference characters are used throughout the different figures to designate the same components. FIG. 1 is an exploded view of an embodiment of a folding knife 50 constructed and arranged according to the principle of the invention. The knife 50 has safety features for preventing the accidental opening and closing of the knife 50 during use and storage of the knife 50. The knife 50 includes a blade 51 mounted for pivotal movement to a handle assembly 52 formed of opposed left and right handle portions 53 and 54. The left and right handles portions 53 and 54 are symmetric and, as such, reference will be made to the right handle portion 54, and the constituent parts thereof, with the understanding that the discussion applies equally to the left handle portion 53, and the constituent parts thereof which will be identified with a prime ("'") to distinguish those parts from the parts of the right handle portion 54. In some instances, reference will be made to the constituent parts of the left handle portion 53 for clarity of illustration, and it should be understood that the discussion applies equally to the right handle portion 54. Except as otherwise identified herein, all parts of the knife 50 are constructed from hard, durable, and rigid materials, such as metal, hardened metal, wood, plastic, or ceramic materials.

The right handle portion 54 includes a handle 55 and a liner 56. The handle 55 has an outer surface 55*a* and an opposed inner surface 55*b*, and a front 55*c* and an opposed butt 55*d*. The liner 56 has an outer surface 56*a* and an opposed inner surface 56*b*, and a front 56*c* and an opposed butt 56*d*. Likewise, the left handle portion 53 includes a handle 55' and a liner 56'. The handle 55' has an outer surface 55*a*' and an opposed inner surface 55*b*', a front 55*c*' and an opposed butt 55*d*', and a peripheral edge 52*a*. The liner 56' has an outer surface 56*a*' and an opposed inner surface 56*b*', and a front 56*c*' and an opposed butt 56*d*'.

With continuing reference to FIG. 1, the handle assembly 52 also includes an elongate spacer 57 having a front 57*a*, an opposed arcuate butt 57*b*, and opposed left and right surfaces 57*c* and 57*d*. The spacer 57 has a thickness A between the left and right surfaces 57*c* and 57*d*. The spacer 57 is also formed with an arcuate notch 57*e* proximate to the front 57*a* extending through the spacer 57 between the left and right surfaces 57*c* and 57*d*.

The handle assembly 52 is fastened together with fasteners 60 secured between the left and right handle portions 53 and 54. The fasteners 60 extend from the handle 55', through the liner 56', the spacer 57, the liner 56, and the handle 55. Secured in this manner, the inner surface 55*b* of the handle 55 is in contact with the outer surface 56*a* of the liner 56, the inner surface 56*b* of the liner 56 is in contact with the right surface 57*d* of the spacer 57, the left surface 57*c* of the spacer 57 is in contact with the inner surface 56*b*' of the liner 56', and the outer surface 56*a*' of the liner 56' is in contact with the inner surface 55*b*' of the handle 55'. The inner surfaces 56*b* and 56*b*' of the liners 56 and 56', respectively, cooperate with the spacer 57 to define a channel 61 in the handle assembly 52 between the left and right handle portions 53 and 54 for receiving the blade 51 in a storage or closed position of the blade 51. The peripheral edge 52*a* on the handle 55' has a downward edge 52*a*, referenced in FIG. 1 on the liner 56, about which a user's fingers are wrapped when the knife 50 is being used, and an opposed back edge 52*c*. The downward edge 52*b* is directed downward when the knife 50 is gripped in a forward gripping arrangement and being used. In the forward gripping arrangement, the user's hand is wrapped around the handle assembly 52, with the palm against the back edge 52*c* and the fingers around the downward edge 52*b* of the knife 50.

The blade 51 has a tang 62 mounted to the handle assembly 52, an opposed tip or point 63, and an edge 64 and opposed spine 65. The blade 51 has a thickness B as indicated in FIG. 1 which is just less than the thickness A of the spacer 57 so that the blade 51 may be stored within the channel 61 in the spacer 57. The tang 62 is mounted for rotation to the handle assembly 52 on a pin or rivet 60 proximate to the fronts 55*c*, 56*c*, 55*c*', 56*c*', and 57*a* of the handle 55, the liner 56, the handle 55', the liner 56', and the spacer 57, respectively, for pivotal movement along double-arrowed line I about an axis C, indicated in dotted line in FIG. 1, between an extended, deployed, or open position in which the point 63 of the blade 51 is away from the handle assembly 52 opposite the butt 57*b* of the spacer 57, and a retracted, stored, or closed position in which the blade 51 is within the channel 61 in the handle assembly 52 and the point 63 is proximate to the butt 57*b* of the spacer 57. In the open position of the blade 51, the edge 64 of the blade 51 is collinear with the downward edge 52*b* of the handle assembly 52.

The tang 62 has an arcuate outer edge 62*a* defined between opposed left and right faces 62*b* and 62*c*. The left and right faces 62*b* and 62*c* are flat, parallel to each other, and perpendicular to the axis C of pivotal movement of the blade 51. The outer edge 62*a* is contoured around the tang 62 and formed with first, second, and third notches 116, 117, and 118. The left and right faces 62*b* and 62*c* are formed with detents 73 and 74, respectively, which are generally hemispherical depressions extending into the tang 62 from the left and right surfaces 62*b* and 62*c*.

The knife 50 has structure to lock the blade 51 when the knife 50 is gripped in the forward gripping arrangement and used. Two grip locking assemblies 75 and 76 are carried by the knife 50 on the handle assembly 52 and are operatively coupled to the blade 51. The grip locking assemblies 75 and 76 are identical in every respect to each other, other than location and as otherwise noted herein, and as such, reference will be made only with respect to the grip locking assembly 76 with the understanding that the discussion applies equally to the grip locking assembly 75, and the constituent parts of the grip locking assembly 75 will be identified with a prime ("'") to distinguish those parts from those of the grip locking assembly 76.

The grip locking assembly 76 includes a cam 80, an axle 81 on which the cam 80 is mounted for rotation, a spring 82 exerting a bias on the cam 80 about the axle 81, a depression 83 in the liner 56, a bore 84 through the liner 56 along an axis D, a ball 85 carried in the bore 84, and the detent 74. The depression 83 is a recess extending into the liner 56 from the outer surface 56*a* of the liner 56 at the downward edge 52*b* of the handle assembly 52 and is sized and shaped to receive the cam 80. The axle 81 is a bolt having an enlarged head fit within a socket 86 on the outer surface 55*a* of the handle 55, a shank extending into the handle assembly 52 and encircled by a hole 80*a* through the cam 80, and a threaded end secured to a threaded hole 83*a* in the depression 83. The cam 80 is mounted with a frictional-bearing fit on the shank of the axle 81 for pivotal movement of the cam 80 with respect to the depression 83 about an axis E shown in FIG. 1 between a raised, or released, position of the cam 80 and a lowered, or gripped, position of the cam 80. Axis D is parallel to axes C and E and is normal to a plane defined by the pivotal movement of the cam 80.

Figure 2A:
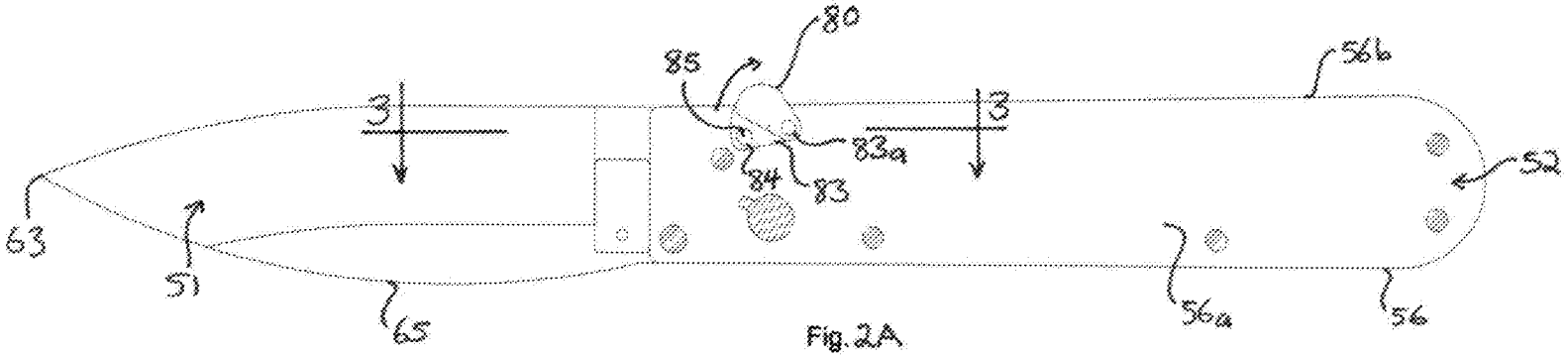
FIGS. 2A and 2B are section views taken along the line 2-2 in FIG. 1, showing the grip locking assembly of FIG. 1 in an unlocked configuration and a locked configuration, respectively.
Figure 3B:
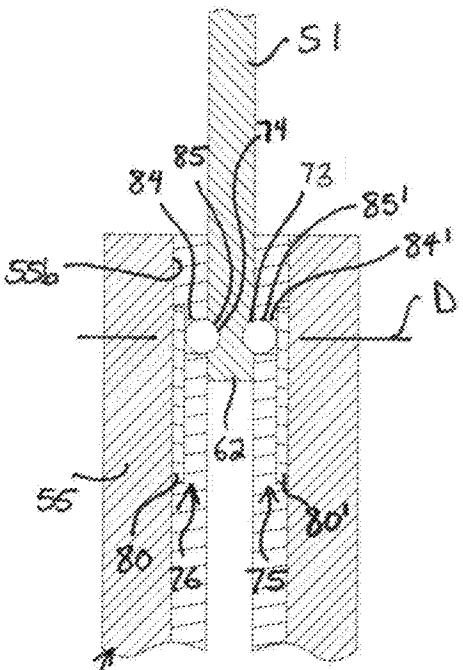
FIGS. 3A and 3B are section views taken along the line 3-3 of FIGS. 2A and 2B, showing the blade in an open position and the grip locking assembly of FIG. 1 arranged in the unlocked and locked configurations, respectively.
Figure 3A:
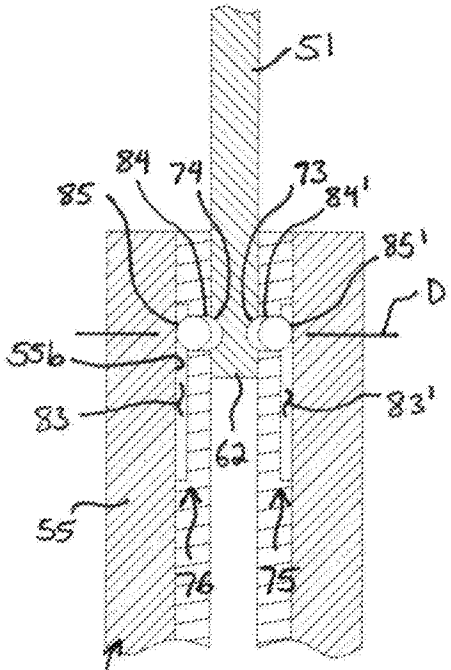

The spring 82 is a torsional spring fitted on the axle 81 which biases the cam 80 into the raised position. As seen in FIG. 2A, which is a sectional view taken along the line 2-2 in FIG. 1, in the raised position of the cam 80, the cam 80 projects above the downward edge 52*b* of the peripheral edge 52*a* of the handle assembly 52. The ball 85, which is carried in the bore 84 when the cam 80 is in the raised position, is free to move within the bore 84 and does not interact with the cam 80 which is away from the bore 84. FIG. 3A illustrates a section view taken along the line 3-3 in FIG. 2A, in which the cam 80 is not visible because the cam 80 is in the raised position partially out of the depression 83, and the ball 85 is carried in the bore 84 proximate to the inner surface 55*b* of the handle 55, out of the detent 74. With the ball 85 located out of the detent 74, the tang 62 of the blade 51 is free to pivot between the open and closed positions of the blade 51 without interference with the ball 85. With both cams 80 and 80' moved into the raised positions thereof projecting beyond the downward edge 52*b*, and the balls 85 and 85' within the bores 84 and 84', the grip locking assemblies 75 and 76 each define an unlocked configuration in which the blade 51 is free to pivot.

Figure 2B:
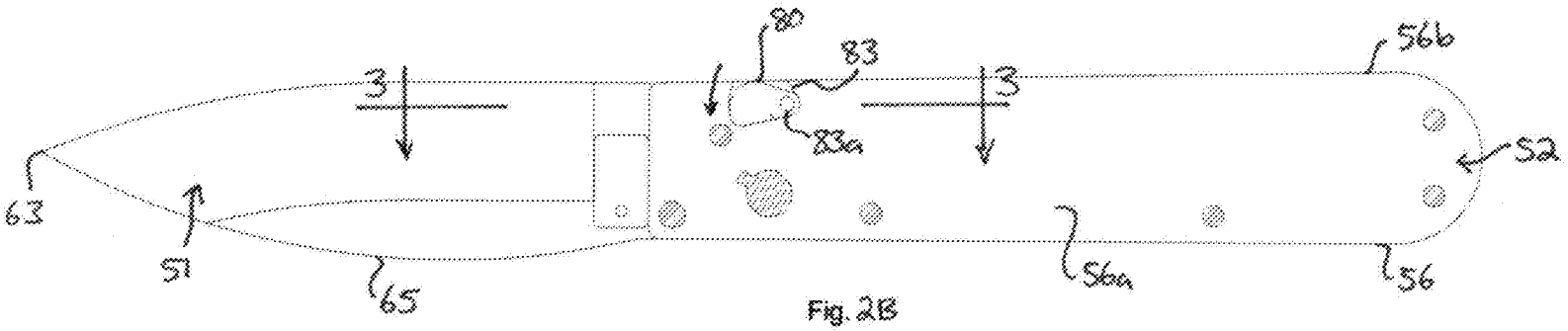

As seen in FIG. 2B, which is a sectional view also taken along the line 2-2 in FIG. 1, in the lowered position of the cam 80, the cam 80 is recessed within the depression 83, so that the cam 80 is one of flush with and just below the downward edge 52*b* of the peripheral edge 52*a* of the handle assembly 52. FIG. 3B illustrates a section view taken along the line 3-3 in FIG. 2B, in which the ball 85, carried in the bore 84, encounters the cam 80. The cam 80 in the depression 83 interacts with and urges the ball 85 along axis D toward the tang 62 of the blade 51, moving the ball 85 in translational movement through the bore 84 into the detent 74. The detent 74 is sized and shaped to receive approximately a hemispherical portion of the ball 85, so that with the ball 85 received in the detent 74, a portion of the ball 85 remains outside of the detent 74 in the bore 84, and the ball 85 is located in an interference position juxtaposed with the tang 62. The ball 85 is maintained in this position, prevented from moving laterally along axis D with respect to the tang 62 by the detent 74 on one side of the ball 85 and the cam 80 on the other side of the ball 85, so that the ball 85 defines an impedance to pivotal movement of the blade 51 that is fixed within the handle assembly 52. With the ball 85 against the tang 62, the blade 51 is prevented from moving between the open and closed positions. With both cams 80 and 80' moved into the lowered positions thereof into the depressions 83 and 83', and the balls 85 and 85' located within the detents 74 and 73 in juxtaposition with the tang 62 of the blade 51, the grip locking assemblies 75 and 76 each define a locked configuration in which the blade 51 is prevented from pivotal movement.

With reference back to FIG. 1, the spring 82 biases the cam 80 into the raised position. When a user desires to use the knife 50, the user grips, as by hand, the knife 50 in the forward gripping arrangement in which the user's hand is wrapped around the handle assembly 52 and the fingers are around the downward edge 52*b* of the knife 50, so that the fingers are against the cams 80 and 80'. By closing or tightening the user's grip on the knife 50 in the forward gripping arrangement, the user's fingers depress the cams 80 and 80' into the lowered positions thereof, urging the balls 85 and 85' into the detents 74 and 73 so that the grip locking assemblies 75 and 76 are in the locked configuration while the user grips the knife 50. The knife 50 is then used while the user maintains the forward gripping arrangement on the knife 50, thus maintaining the cams 80 and 80' in the lowered positions and the grip locking assemblies 75 and 76 in the locked configurations during operation.

Figure 4:
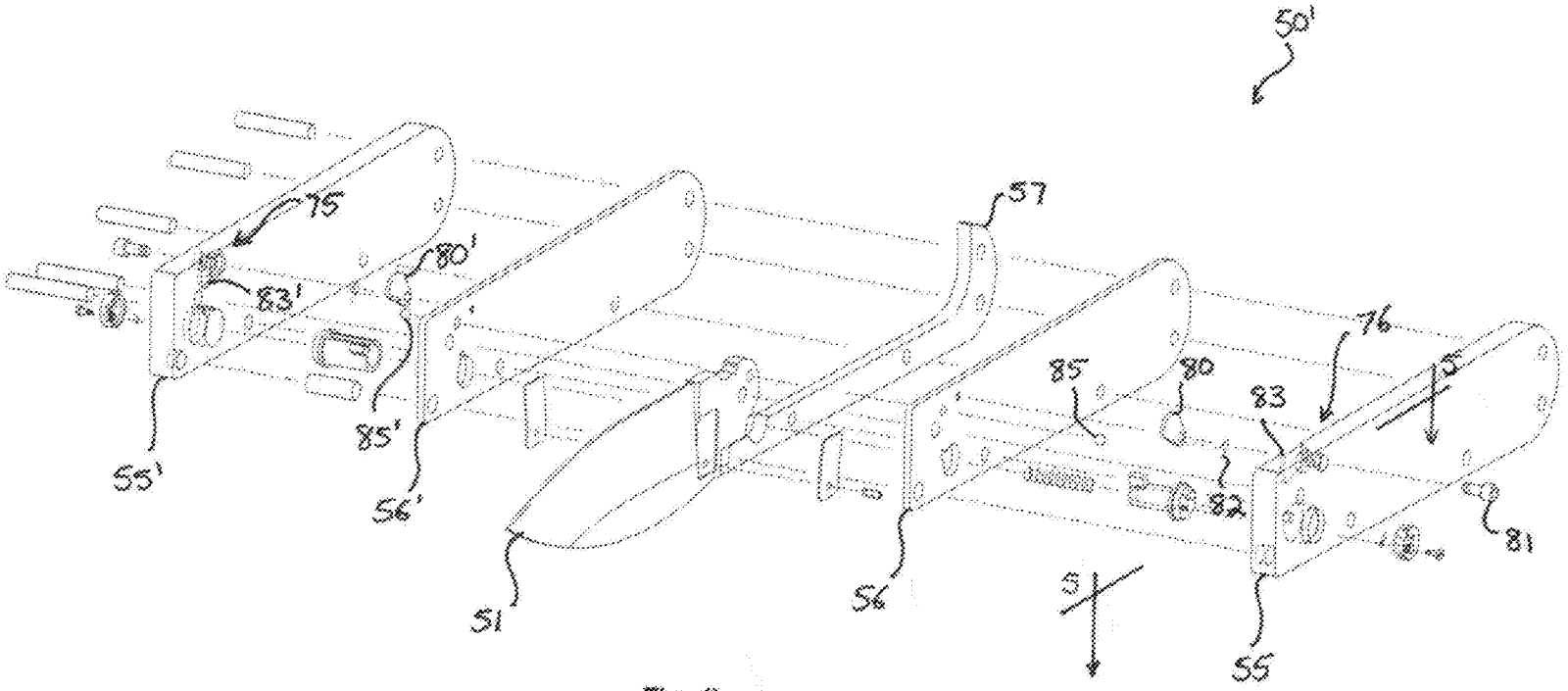
FIG. 4 is a view similar to that of FIG. 1, showing an alternate embodiment of a folding knife having a grip locking assembly carried in the handle assembly.
Figure 5B:
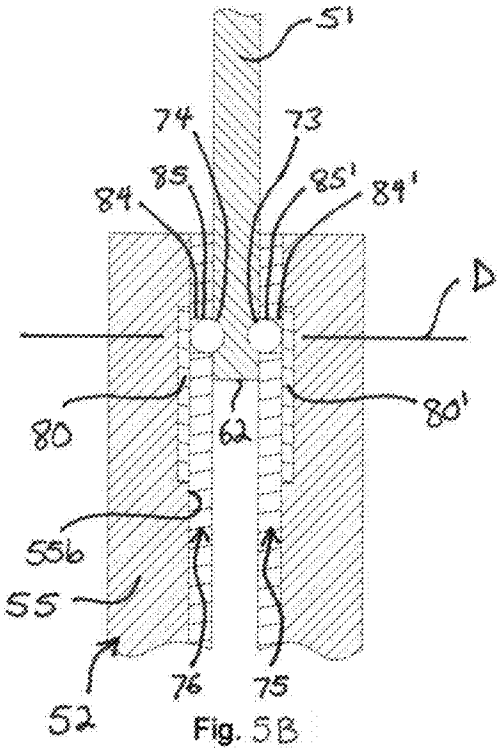
FIGS. 5A and 5B are section views taken along the line 5-5 in FIG. 4, showing the grip locking assembly of FIG. 4 in an unlocked configuration and a locked configuration.
Figure 5A:
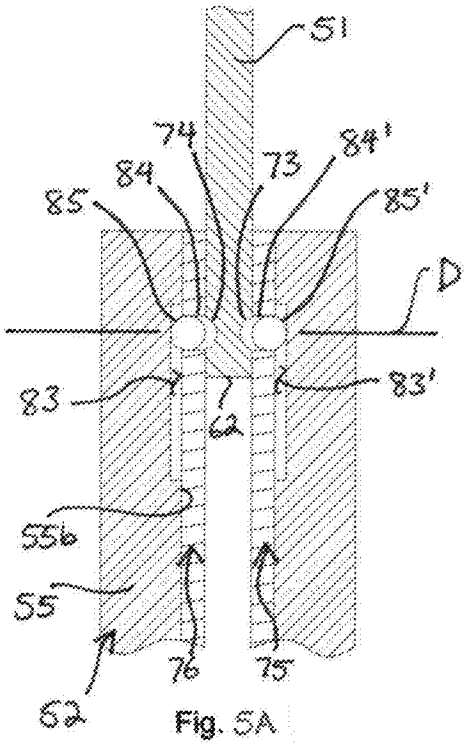

Briefly, an alternate embodiment is shown in FIGS. 4, 5A, and 5B as knife 50'. FIGS. 5A and 5B are section views taken along line 5-5 in FIG. 4. The knife 50' includes features identical to that of the knife 50, as indicated with common reference numbers. However, in knife 50', the depressions 83 and 83' are carried on the right and left handle portions 54 and 53, respectively, rather than the liners 56 and 56'. One having ordinary skill in the art will understand that operation of the knife 50' is the same as operation of the knife 50.

Figure 6:
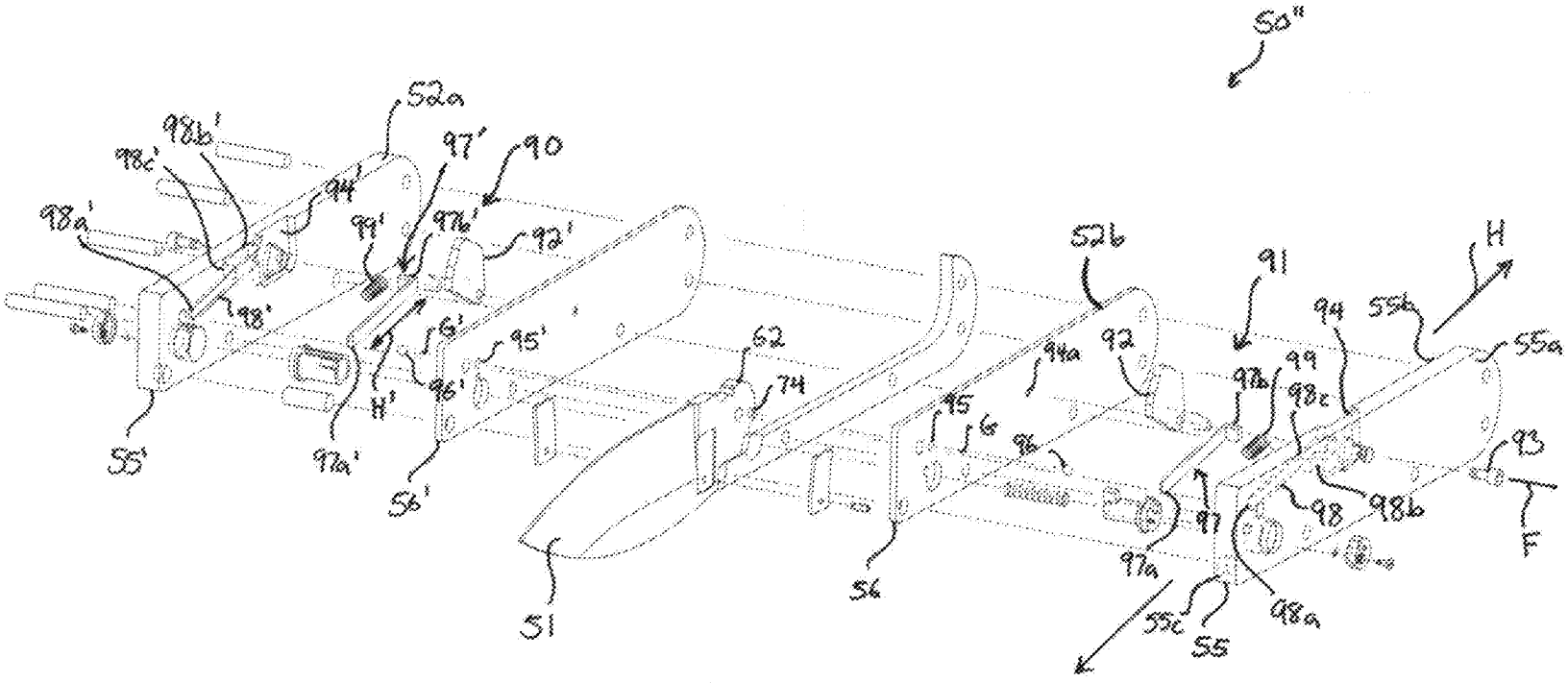
FIG. 6 is a view similar to that of FIG. 1, showing an alternate embodiment of a folding knife having a grip locking assembly.

Another embodiment is shown in FIG. 6 as knife 50". The knife 50" includes features identical to that of the knife 50, as indicated with common reference numbers. However, the knife 50" includes alternate grip locking assemblies 90 and 91, which are different from the grip locking assemblies 75 and 76. The grip locking assemblies 90 and 91 are identical in every respect to each other, other than location and as otherwise noted herein, and as such, reference will be made only with respect to the grip locking assembly 91 with the understanding that the discussion applies equally to the grip locking assembly 90, and the constituent parts of the grip locking assembly 90 will be identified with a prime ("") to distinguish those parts from those of the grip locking assembly 91.

The grip locking assembly 91 includes a cam 92, an axle 93 on which the cam 92 is mounted for rotation, a depression 94 in the handle 55, a bore 95 extending along an axis G through the liner 56, a ball 96 carried in the bore 95, a rod 97 carried in a channel 98 extending between the depression 94 and the bore 95, and a spring 99 exerting a bias on the rod 97 toward the cam 92. Axis F is parallel to axis C and normal to a plane defined by the pivotal movement of the cam 92.

The depression 94 is a recess extending into the handle 55 from the inner surface 55*b* of the handle 55 and is sized and shaped to receive the cam 92. The axle 93 is a bolt having an enlarged head fit within a socket on the outer surface 55*a* of the handle 55, a shank extending into the handle assembly 52, and a threaded end secured to a threaded hole 94*a* in the liner 56 proximate to the depression 94. The cam 92 is mounted with a frictional-bearing fit on the shank of the axle 93 for pivotal movement of the cam 92 with respect to the depression 94 about an axis F shown in FIG. 6 between a raised, or released, position of the cam 92 and a lowered, or gripped, position of the cam 92. Axis F is parallel to axis G.

The channel 98 is formed in the handle 55 and includes a front 98*a* located proximate to the front 55*c* of the handle 55 and an opposed rear 98*b* located at the depression 94. A shoulder 98*c* is formed at the rear 98*b*. The rod 97 is fit within the channel 98 and includes a tapered head 97*a* and an opposed angled foot 97*b*. The head 97*a* is located proximate to the front 98*a* of the channel 98, and the foot 97*b* is proximate to the rear 98*b* in juxtaposition with the cam 92.

The rod 97 reciprocates in a direction generally indicated by double-arrowed line H within the channel 98 in response to pivotal movement of the cam 92. The rod 97 moves into an advanced position along the handle 55 toward the front 55*c* in response to movement of the cam 92 into the lowered position, and the rod 97 moves into a retracted position along the handle away from the front 55*c* in response to movement of the cam 92 into the raised position. The spring 99 is a linear spring and is spaced between the shoulder 98*c* and the foot 97*b* to urge the rod 97 into the retracted position and the cam 92 into the raised position. When the rod 97 is in the retracted position, the tapered head 97*a* of the rod 97 is away from the bore 95 and from the ball 96, and the ball 96 is free to move outside of the detent 74 within the bore 95. With the ball 96 free to move out of the detent 74, the tang 62 of the blade 51 is free to pivot between the open and closed positions of the blade 51 without interference with the ball 96. With both cams 92 and 92' moved into the raised positions thereof projecting beyond the downward edge 52*b* of the peripheral edge 52*a*, and the balls 96 and 96' within the bores 95 and 95', the grip locking assemblies 90 and 91 each define an unlocked configuration in which the blade 51 is free to pivot.

When the cam 92 is lowered, as by taking up the knife in a forward gripping arrangement as discussed above, the rod 97 is moved into the advanced position, and the tapered head 97*a* of the rod 97 is proximate to the bore 95, interacting with and urging the ball 96 to translate along axis G toward the tang 62 of the blade 51 into the detent 74. The detent 74 is sized and shaped to receive approximately a hemispherical portion of the ball 96, so that with the ball 96 received in the detent 74, a portion of the ball 96 remains outside of the detent 74 in the bore 95, and the ball 96 is located in an interference position juxtaposed with the tang 62. The ball 96 is prevented from moving laterally along axis G with respect to the tang 62 by the detent 74 on one side of the ball 96 and the rod 97 on the other side of the ball 96, so that the ball 96 defines an impedance to pivotal movement of the blade 51 that is fixed within the handle assembly 52. With the ball 96 against the tang 62, the blade 51 is prevented from moving between the open and closed positions. With both cams 92 and 92' moved into the lowered positions thereof into the depressions 94 and 94', and the rods 97 and 97' moved into the advanced positions thereof in response to the movement of the cams 92 and 92' into the lowered positions, and the balls 96 and 96' located within the detents 74 and 73 in juxtaposition with the tang 62 of the blade 51, the grip locking assemblies 90 and 91 each define a locked configuration in which the blade 51 is prevented from pivotal movement. The knife 50" is then used while the user maintains the forward gripping arrangement on the knife 50", thus maintaining the cams 92 and 92' in the lowered positions and the grip locking assemblies 90 and 91 in the locked configurations during operation.

Attention is now directed back to FIG. 1. The blade 51 has opposed sides 51*a* and 51*b* and locking members 100 and 101 carried on sides 51*a* and 51*b*, respectively. The locking members 100 and 101 define projections on the sides 51*a* and 51*b* to prevent the accidental movement of the blade from the open position to the closed position. The locking members 100 and 101 are identical in every respect to each other, other than location and as otherwise noted herein, and as such, reference will be made only with respect to the locking member 100 with the understanding that the discussion applies equally to the locking member 101, and the constituent parts of the locking member 101 will be identified with a prime ("") to distinguish those parts from those of the locking member 100.

The locking member 100 includes an elongate, slightly arcuate leaf 102 mounted within a depression 103 formed in the side 51*a* of the blade 51 at the tang 62. The leaf 102 is thin and has opposed first and second ends 102*a* and 102*b* and an inner edge 102*c* directed toward the handle assembly 52. The first end 102*a* is fixed to the blade 51 with a fastener, such as a bolt, a rivet, a weld, or the like, and the second end 102*b* defines a free end. The leaf 102 is proximate to the peripheral edge 52*a* of the handle assembly 52 and is aligned generally transverse with respect to the blade 51, with the first end 102*a* proximate to the spine 65 of the blade 51 and the opposed second end 102*b* proximate to the edge 64 of the blade 51.

The leaf 102 is constructed from a spring material having resilient and shape-memory material characteristics. The material characteristics and shape of the leaf 102 bias the leaf 102 outwardly away from the side 51*a* of the blade 51, such that the second end 102*b* defines a projection above the side 51*a*, arcuately curving away from the first end 102*a* secured within the depression 103. The second end 102*b* is directed toward the direction of pivotal movement of the blade 51 from the open position to the closed position, preventing accidental depression of the leaf 102 from the raised position simply by closing the blade 51.

Figure 7A:
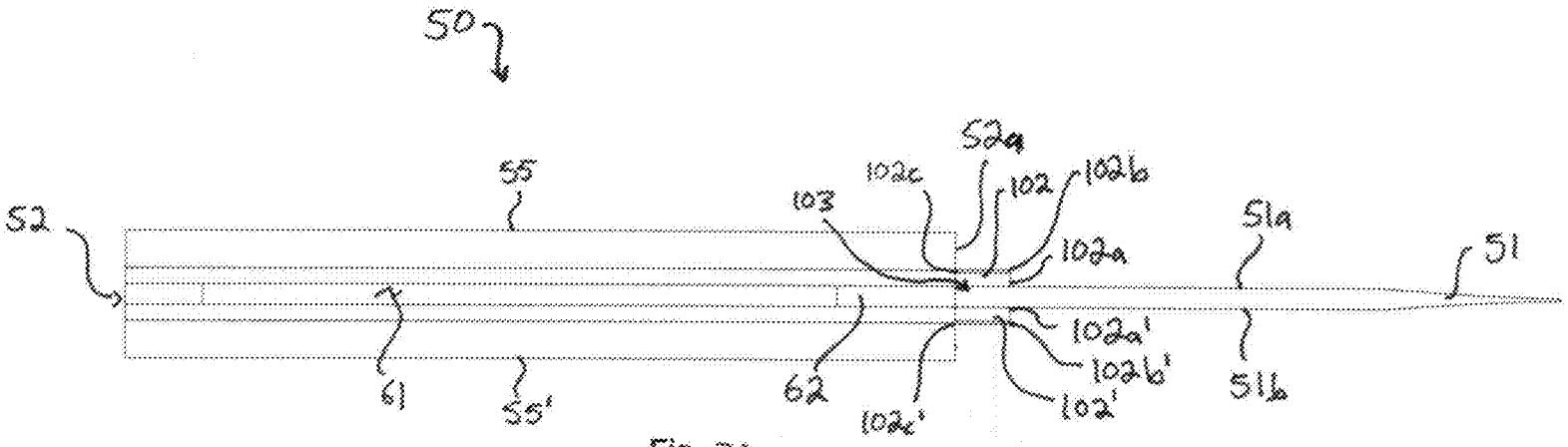
FIGS. 7A and 7B are top plan views of the knife of FIG. 1 showing the locking member in a raised position and a collapsed position, respectively.

The leaf 102 moves between a collapsed position and a raised position when the blade 51 is in the open position. In the closed position of the blade 51, the leaf 102 is in the collapsed position and is maintained in the collapsed position by interaction with the liner 56. As seen in FIG. 7A, in the open position of the blade 51 and the raised position of the leaf 102, the second end 102*b* of the leaf 102 is raised out of the depression and projects above the side 51*a*. The inner edge 102*c* of the leaf 102 is in direct contact with the peripheral edge 52*a* of the handle assembly 52, and the leaf 102 extends away from the handle assembly 52. The direct juxtaposition of the inner edge 102*c* of the leaf 102 with the peripheral edge 52*a* of the handle assembly 52 in the raised position of the leaf 102, prevents movement of the blade 51 from the open position to the closed position.

Figure 7B:
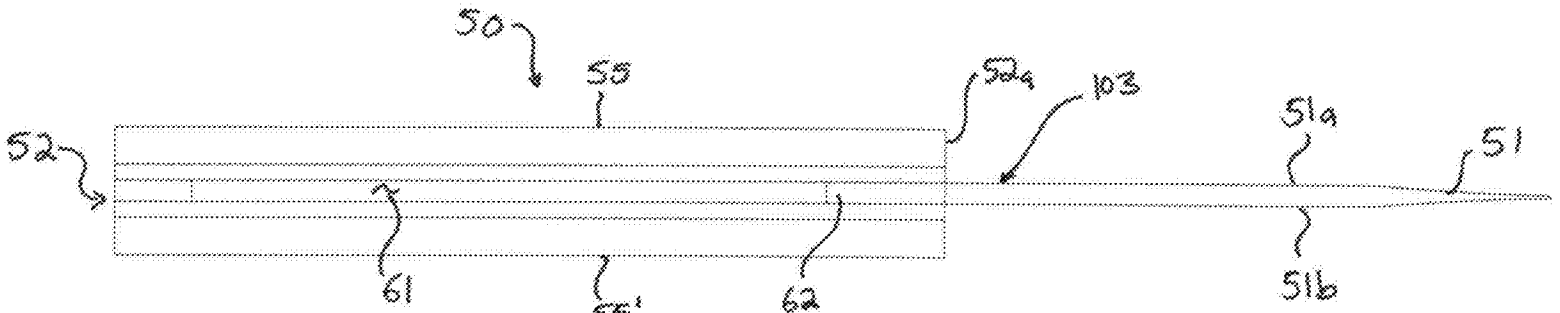

As seen in FIG. 7B, in the open position of the blade 51 and the collapsed position of the leaf 102, the second end 102*b* of the leaf 102 is depressed with respect to the handle assembly 52, is depressed into the depression 103, and is one of flush with and just inboard of the side 51*a*, so as present a surface on the side 51*a* of the blade 51 that is free of impedance to the pivotal movement of the blade 51 from the open position to the closed position so as to allow the blade 51 to pivot from the open to the closed position.

The leaf 102 is moved into the collapsed position by taking up the knife 50, as by hand, and depressing the second end 102*b* of the leaf 102 with a finger toward the blade 51. The leaves 102 and 102' may be simultaneously placed into the collapsed position by the user placing his fingers on each of the leaves 102 and 102' and pinching his fingers into the blade 51.

Figure 8:
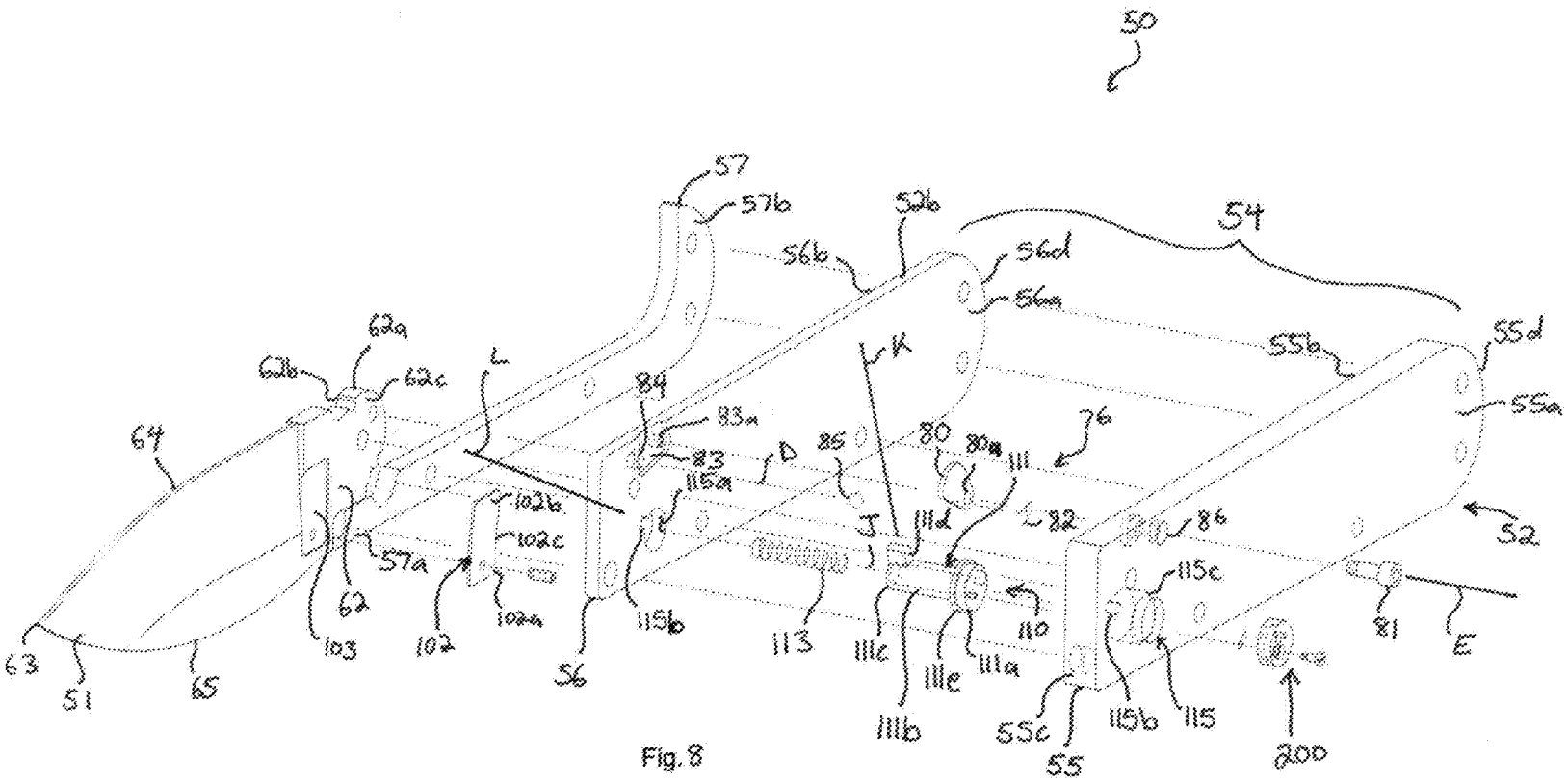
FIG. 8 illustrates a right-half portion of the view in FIG. 1.

Attention is now directed to FIG. 8, which depicts the same knife 50 as in FIG. 1 but shows a right half of the knife 50 in greater detail. A bolt locking assembly 110 is shown in exploded view. Bolt locking assembly 110 includes a first bolt 111 carried in the handle assembly 52, a second bolt 112 carried in the handle assembly 52 (shown in FIG. 1; not shown in FIG. 8), and a linear compression spring 113 compressed between the first and second bolts 111 and 112.

The first bolt 111 has an enlarged head 111*a*, a hollow, co-axial shank 111*b* extending from the head 111*a* and terminating at an open end 111*c* along an axis J, and a lug 111*d* formed on the shank 111*b* at the open end 111*c*. The lug 111*d* is a protuberance from a surface of the shank 111*b* and projects radially outward from the shank 111*b* along an axis indicated by line K in FIG. 8.

The second bolt 112 has an enlarged head 112*a*, a hollow, co-axial shank 112*b* extending from the head 112*a* and terminating at an open end 112*c* along axis J, a lug 112*d* formed on the shank 112*b* at the open end 112*c*, and an axial slot 112*e* offset from the lug 112*d* extending along the shank 112*b* from the open end 112*c* to the head 112*a*. The shank 112*b* with the slot 112*e* defines a severed sleeve. The lug 112*d* projects radially outward from the shank 112*b* along an axis indicated by line L in FIG. 8.

The first and second bolts 111 and 112 are coaxial and are carried for reciprocation in the handle assembly 52 with respect to each other. Coaxial first and second bores 114 and 115 are formed through the handle assembly 52 and carry first and second bolts 111 and 112. The first bore 114 is formed in the left handle portion 53 and is sized and shaped to receive the shank 111*b* proximate to the end 111*d* and the lug 111*d* for reciprocation of the first bolt 111 within the first bore 114. The first bore 114 defines an opening 114*a* through the liner 56' and the handle 55', and includes a notch 114*b* extending radially outwardly away from the opening 114*a* along the line K. The opening 114*a* is sized to receive the head 112*a* of the second bolt 112. The opening 114*a* in the handle 55' includes an inner annular shoulder 114*c* to prevent the head 112*a*, which is formed with a flange 112*f*, from passing axially through the handle 55'.

The second bore 115 is formed in the right handle portion 54 and is sized and shaped to receive the shank 112*b* proximate to the end 112*d* and the lug 112*d* for reciprocation of the second bolt 112 within the second bore 115. The second bore 115 defines an opening 115*a* through the liner 56 and the handle 55, and includes a notch 115*b* extending radially outwardly away from the opening 115*a* along the line L. The opening 115*a* is sized to receive the head 111*a* of the first bolt 111. The opening 115*a* in the handle 55 includes an inner annular shoulder 115*c* to prevent the head 111*a*, which is formed with a flange 111*e*, from passing axially through the handle 55.

In operation, the bolt locking assembly 110 is useful for locking and unlocking the blade 51 into the open and closed positions of the blade 51. The first bolt 111 fits within a bore 112*g* formed in the second bolt 112, with the lug 111*d* protruding through the slot 112*e* beyond the shank 112*b* of the second bolt 112, so that the first bolt 111 is free to reciprocate within the bore 112*g* of the second bolt 112 and the lug 111*d* is free to reciprocate within the slot 112*e*. The lugs 111*d* and 112*d* extend radially outward along respective axes along lines K and L, respectively, and are radially offset by an amount θ, which is preferably 40 degrees but could be another amount as will be understood. The spring 113 is located between the first and second bolts 111 and 112 and exerts an axial bias outwardly on each of the first and second bolts.

Figure 9:
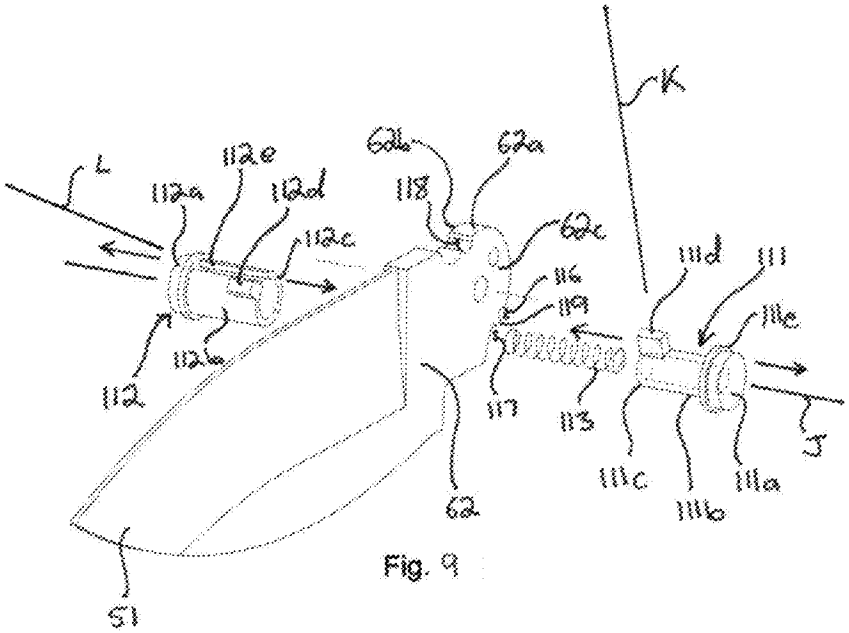
FIG. 9 is an isolated, exploded perspective view of the blade and the bolt locking assembly of FIG. 1.

The tang 62 of the blade 51 is formed with structure to engage with the first and second bolts 111 and 112. With reference to FIG. 9, which shows the blade and the bolt locking assembly in greater detail, the arcuate outer edge 62*a* of the tang 62 includes the first, second, and third notches 116, 117, and 118. The first and second notches 116 and 117 are directed toward the spacer 57 when the blade 51 is in the open position. The first and second notches 116 and 117 are radially spaced apart on the outer edge 62*a* and aligned with lines K and L, respectively, along which lugs 111*d* and 112*d* extend, and are shaped to receive lugs 111*d* and 112*d*, respectively. A projection, or finger 119, extends radially outward from the tang 62 between the notches 116 and 117 to define and separate the notches 116 and 117.

Figure 10:
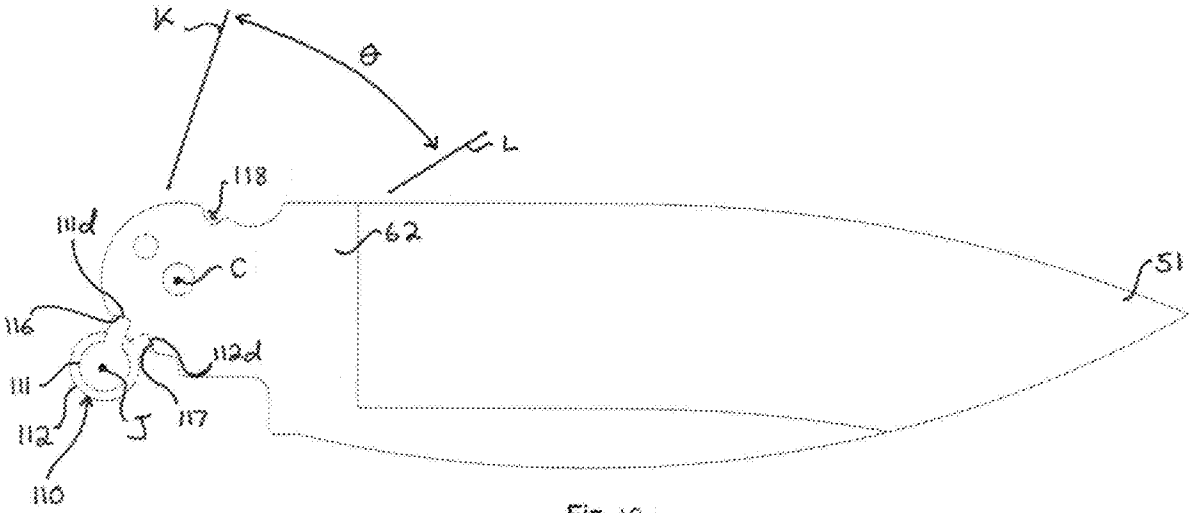
FIG. 10 is an isolated side elevation view of the blade and the bolt locking assembly of FIG. 1 in an open position of the blade.
Figure 11:
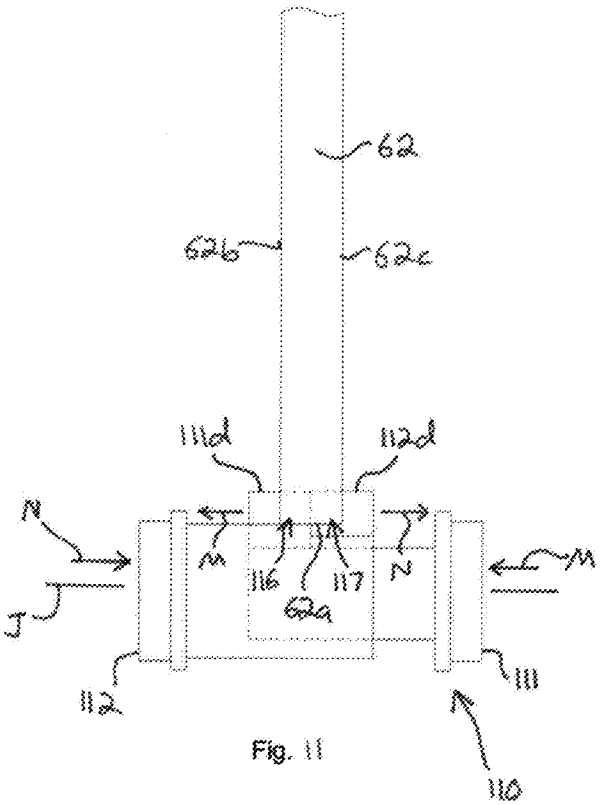

With the blade 51 in the open position, the lug 111*d* reciprocates past the notch 116 along axis J, and the lug 112*d* reciprocates past the notch 117 along axis J. Reference is now made to FIG. 10, which shows the bolt locking assembly 110 engaged with the tang 62 and the blade 51 pivoted about axis C into the open position of the blade 51. The lugs 111*d* and 112*d* are aligned with the arcuate outer edge 62*a* and are closely received within the notches 116 and 117, respectively, as shown in FIG. 11. Although not visible in FIG. 10, the lug 111*d* is fit within both the notch 116 and the notch 114*b* in the handle 55' and the liner 56', so that the lug 111*d* is fixed with respect to the handle 55' and the first bolt 111 is prevented from rotational movement about axis J by the interaction of the lug 111*d* with the notch 114*b*. Similarly, the lug 112*d* is fit within both the notch 117 and the notch 115*b* in the handle 55 and the liner 56, so that the lug 112*d* is fixed with respect to the handle 55 and the second bolt 112 is prevented from rotational movement about axis J by the interaction of the lug 112*d* with the notch 115*b*. With the lugs 111*d* and 112*d* are each engaged with the tang 62 in an interference position, and the blade 51 in the open position, the bolt locking assembly 110 is arranged in a locked configuration preventing the rotation of the blade 51 from the open position toward the closed position.

Figure 12:
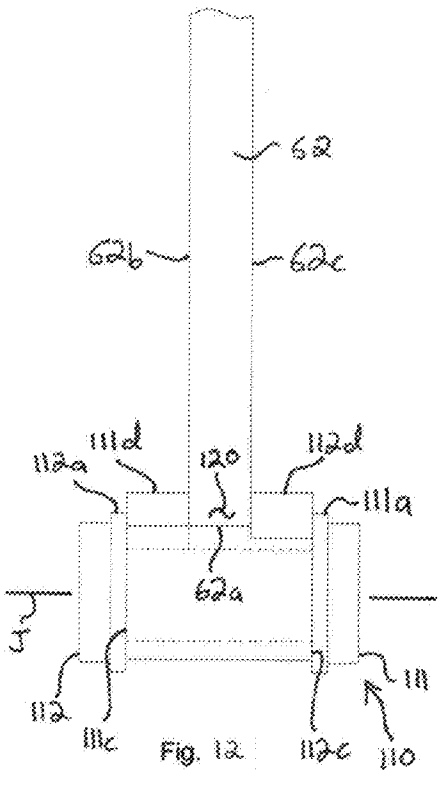
FIGS. 11 and 12 are isolated, top plan views of the blade and bolt locking assembly of FIG. 10 in a locked configuration and an unlocked configuration, respectively, of the bolt locking assembly.

To move the blade 51 from the open position to the closed position, the bolt locking assembly 110 must be moved from the locked configuration to an unlocked configuration. To do so, the user places his fingers on the heads 111*a* and 112*a* and depresses the first and second bolts 111 and 112 inward along axis J. The first bolt 111 is depressed along axis J in a direction indicated by arrowed line M in FIG. 11 until the lug 111*d* is opposite the tang 62 from the head 111*a* of the first bolt 111, proximate to the left face 62*b* of the tang 62, as shown in FIG. 12. Movement along line M is limited by the interaction of the open end 111*c* with the head 112*a*. Similarly, the second bolt 112 is depressed along axis J in a direction indicated by arrowed line N in FIG. 11 until the lug 112*d* is opposite the tang 62 from the head 112*a* of the second bolt 112, proximate to the right face 62*c* of the tang 62, as shown in FIG. 12. Movement along line N is limited by the interaction of the open end 112*c* with the head 111*a*. In this condition, shown in FIG. 12, the bolt locking assembly 110 is in an unlocked configuration and the lugs 111*d* and 112*d* define a groove 120, formed between the lugs 111*d* and 112*d*, in which the outer edge 62*a* of the tang 62 is received during pivotal movement of the blade 51 between the deployed and closed positions. The blade 51 is then rotated between the open and closed positions with the bolt locking assembly 110 in the unlocked configuration. When the blade is moved to the open or closed position and the user releases his fingers from the first and second bolts 111 and 112, the spring 113 compressed between the first and second bolts 111 and 112 urges both the first and second bolts 111 and 112 back into the locked configurations in which the first and second bolts 111 and 112 are in an interference position with the tang 62.

Figure 13:
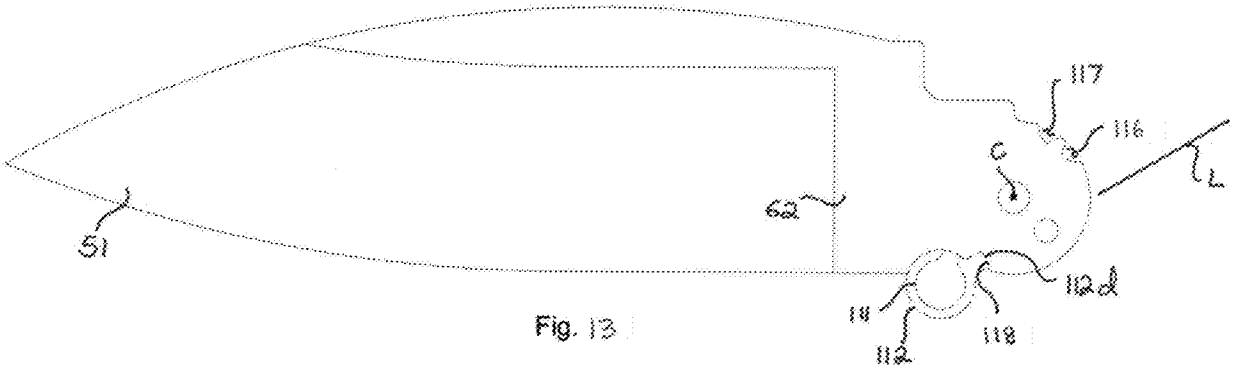
FIG. 13 is an isolated side elevation view of the blade and the bolt locking assembly of FIG. 1 in a closed position of the blade.

Attention is now directed to FIG. 13, which shows the blade 51 in the closed position. The third notch 118 formed in the arcuate outer edge 62*a* of the tang 62 is opposite the tang 62 from the first and second notches 116 and 117 and is aligned with line L along which the lug 112*d* extends when the blade 51 is in the closed position. The lug 112*d* is aligned with the arcuate outer edge 62*a* and is closely received within the notch 118. The lug 112*d* is fit within both the notch 118 and the notch 115*b* in the handle 55 and the liner 56, so that the lug 112*d* is fixed and the second bolt 112 is prevented from rotational movement about axis J by the interaction of the lug 112*d* with the notch 115*b*. With the lug 112*d* engaged with the tang 62 in an interference position, and the blade 51 in the closed position, the bolt locking assembly 110 is arranged in a locked configuration preventing the rotation of the blade 51 from the closed position toward the open position. While in this illustration only the second bolt 112 is depicted as preventing movement out of the closed position of the blade 51, one having skill in the art will readily appreciate that another notch formed in the tang 62 apart from the notch 118 and aligned with the lug 111*d* would allow the first bolt 111 to secure the blade 51 in the locked configuration.

Figure 14:
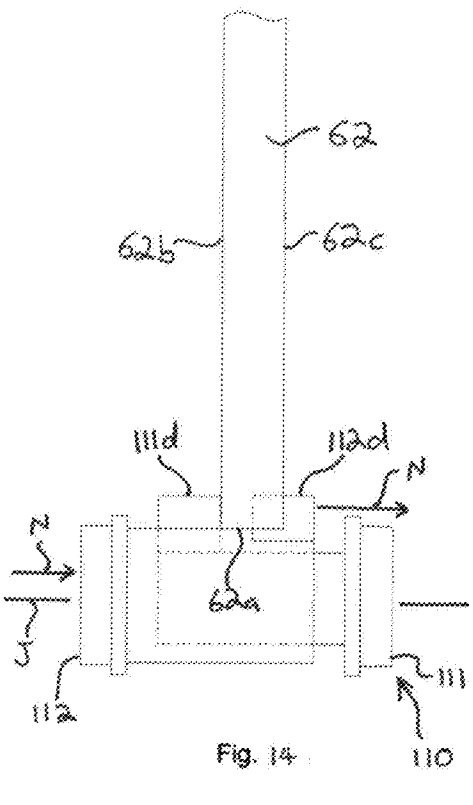
FIG. 14 is an isolated top plan view of the blade and bolt locking assembly of FIG. 13 in a locked configuration of the bolt locking assembly.

As shown in FIG. 14, to release the bolt locking assembly 110 from the locked configuration, the user places his fingers on the head 112*a* and depresses the second bolt 112 inward along axis J, moving the second bolt 112 along axis J in a direction indicated by the arrowed line N, until the lug 112*d* is opposite the tang 62 from the head 112*a* of the second bolt 112, proximate to the right face 62*c* of the tang 62. The first bolt 111 is already depressed along axis J with the lug 111*d* opposite the tang 62 from the head 111*a* of the first bolt 111. The blade is then free to pivot from the closed position to the open position.

Figure 15:
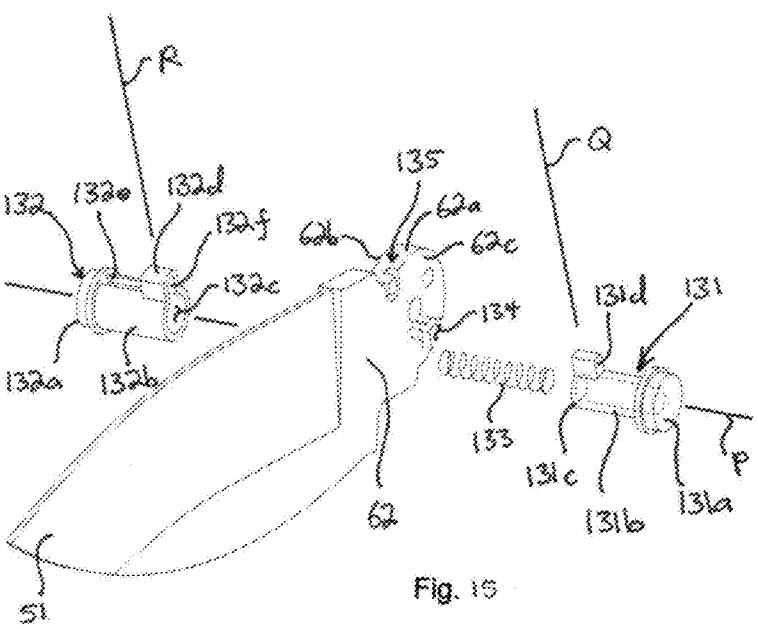
FIG. 15 is an isolated, exploded perspective view of the blade of FIG. 1 and an alternate embodiment of a bolt locking assembly.

An alternate embodiment of the bolt locking assembly 110 is shown in FIG. 15 and is referenced as a bolt locking assembly 130. The bolt locking assembly 130 includes a first bolt 131 carried in the handle assembly 52, a second bolt 132 carried in the handle assembly 52, and a spring 133 between the first and second bolts 131 and 132.

The first bolt 131 has an enlarged head 131*a*, a hollow, co-axial shank 131*b* extending from the head 131*a* and terminating at an open end 131*c* along an axis P, and a lug 131*d* formed on the shank at the open end 131*c*. The lug 131*d* projects radially outward from the shank 131*b* along an axis indicated by line Q in FIG. 15.

The second bolt 132 has an enlarged head 132*a*, a hollow, co-axial shank 132*b* extending from the head 132*a* and terminating at an open end 132*c*, a slotted lug 132*d* formed on the shank 132*b* at the open end 132*c*, and an axial slot 132*e* extending along the shank 132*b* from the open end 132*c* to the head 132*a* through the lug 132*d*. The lug 132*d* projects radially outward from the shank 132*b* along an axis generally indicated by line R in FIG. 15. Lines Q and R are aligned and parallel, so that the lugs 131*d* and 132*d* are aligned axially and aligned circumferentially on bolts 131 and 132, respectively. The lug 132*d* is formed with a cutout 132*f* communicating with the open end 132*c* and the slot 132*e* to allow the second bolt 132 to encircle and receive the open end 131*c* and the shank 131*b* of the first bolt 131 in reciprocation.

FIG. 15 illustrates an alternate embodiment of the blade 51 with the tang 62 having two opposed notches 134 and 135 formed in the arcuate outer edge 62*a* of the tang 62. The notch 134 is formed completely through the tang 62 between the left and right faces 62*b* and 62*c*. The notch 134 has a staggered profile through the tang 62. The notch 134 proximate to the right face 62*c* has a height that is greater than the height of the notch 134 proximate to the left face 62*b*. The height of the notch 134 proximate to the right face 62*c* corresponds to the lug 132*d* so as to receive the lug 132*d*. The height of the notch 134 proximate to the left face 62*b* corresponds to the lug 131*d* so as to receive the lug 131*d*. The lug 132*d* defines a key, and the notch 135 is a keyway, or blind channel, extending partially into the right face 62*c* for receiving the slotted lug 132*d* of the second bolt 132. One having skill in the art will understand that the bolt locking assembly 130 works in the same fashion as the bolt locking assembly 110, with the first and second bolts 131 and 132 reciprocating along axis P to alternately engage and disengage with the tang 62 to lock and unlock, respectively, the blade 51. In the closed position of the blade 51 and the locked configuration of the bolt locking assembly 130, the first bolt 131 is depressed along axis P with the lug 131*d* opposite the tang 62 from the head 131*a* of the first bolt 131, and the lug 132*d* of the second bolt 132 received in contact in the notch 135 on the tang 62, preventing movement of the blade 51.

Figures 16, 17:
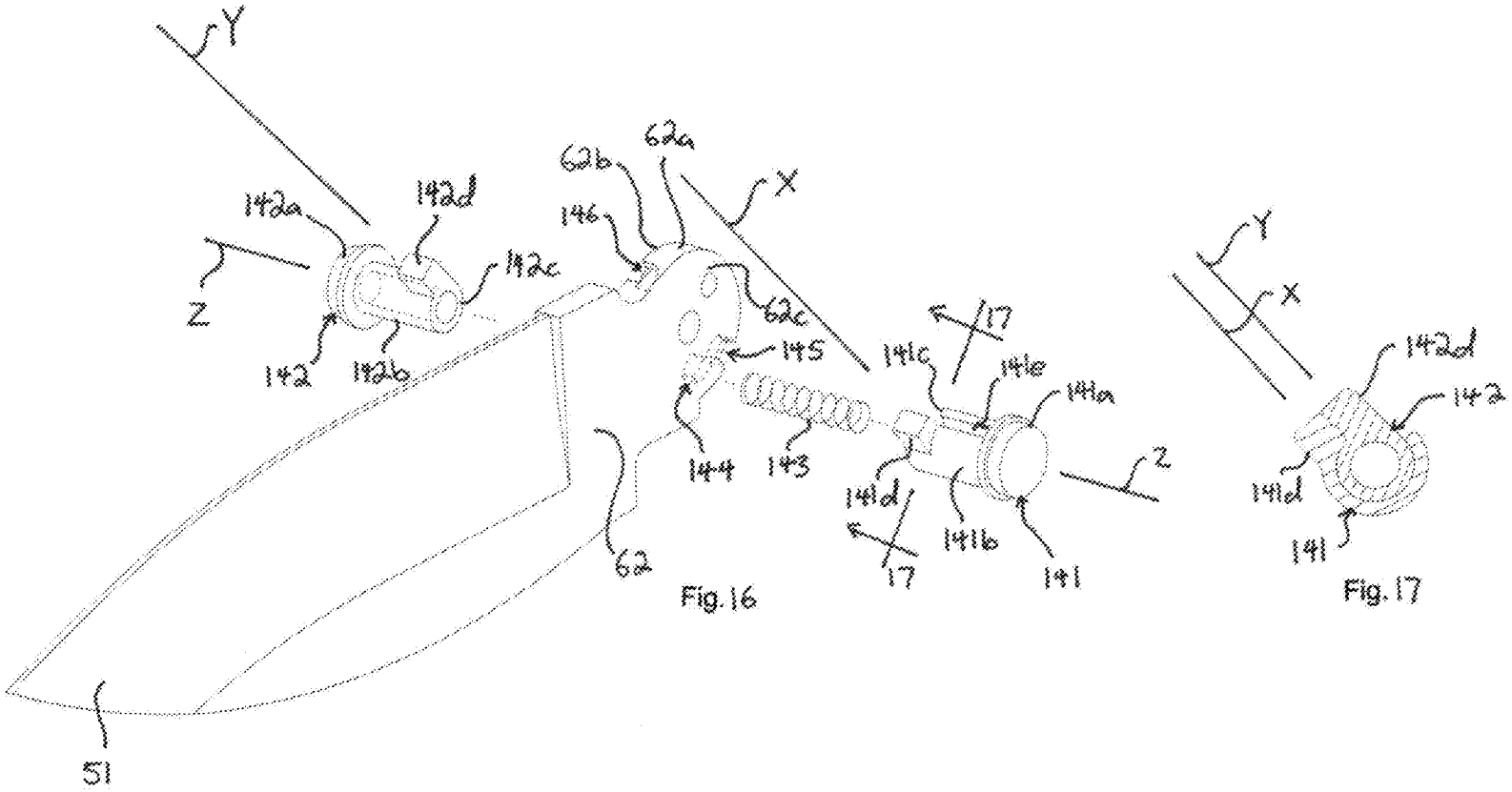
FIG. 16 is an isolated, exploded perspective view of the blade of FIG. 1 and an alternate embodiment of a bolt locking assembly.
FIG. 17 is a section view of the bolt locking assembly of FIG. 16 taken along the line 17-17 in FIG. 16.

An alternate embodiment of the bolt locking assembly 110 for use with the knife 50 is shown in FIG. 16 and is referenced as a bolt locking assembly 140. The bolt locking assembly 140 includes a first bolt 141 carried in the handle assembly 52 (not shown), an opposed second bolt 142 carried in the handle assembly 52, and a spring 143 between the first and second bolts 141 and 142.

The first bolt 141 has an enlarged head 141*a*, a hollow co-axial shank 141*b* extending from the head 141*a* and terminating at an open end 141*c*, an upstanding lug 141*d* formed on the circumference of the shank 141*b* at the open end 141*c*, and an axial slot 141*e* extending along the shank 141*b* from the open end 141*c* to the head 141*a*. The shank 141*b* with the slot 141*e* defines a severed sleeve. The lug 141*d* projects radially outward from the shank 141*b* along an axis indicated by line X in FIG. 16 proximate to the slot 141*e*. The lug 141*d* is offset to a side of the shank 141*b* opposite the slot 141*e*.

The second bolt 142 has an enlarged head 142*a*, a hollow-co-axial shank 142*b* extending from the head 142*a* and terminating at an open end 142*c*, and an upstanding lug 142*d* formed on the circumference of the shank 142*b* at the open end 142*c*. The lug 142*d* is offset to a side of the shank 142*b* and projects radially outward from the shank 142*b* along an axis indicated by line Y in FIG. 16. As seen in the section view of FIG. 17, the lugs 141*d* and 142*d* are circumferentially offset with respect to each other, and the axes X and Y of the lugs 141*d* and 142*d* are parallel. In this way, the lugs 141*d* and 142*d* define a single projection for interference with the tang 62.

FIG. 16 also illustrates an embodiment of the blade 51 with the tang 62 formed with two opposed blind notches 144 and 145 extending partially into the tang 62 from the left and right faces 62*b* and 62*c*, respectively. The notch 144 is formed between the arcuate outer edge 62*a* and the left face 62*b* and extends into the tang 62 to a generally intermediate location between the left and right faces 62*b* and 62*c*. The notch 144 is rectangular and corresponds to the lug 141*d* so as to receive the lug 141*d* snugly. The notch 145 is formed between the arcuate outer edge 62*a* and the right face 62*c* and extends into the tang 62 to a generally intermediate location between the left and right faces 62*b* and 62*c*. The notch 145 is rectangular and corresponds to the lug 142*d* so as to receive the lug 142*d* snugly.

During operation, the first and second bolts 141 and 142 of the bolt locking assembly 140 reciprocate with respect to each other. The first and second bolts 141 and 142 are coaxial, and the shank 142*b* of the second bolt 142 is received coaxially within the shank 141*b* of the first bolt 141 so that the second bolt 142 is encircled by the first bolt 141. The lug 142*d* projects outward from the side of the shank 142*b* of the second bolt 142 through the slot 141*e* of the first bolt 141. The spring 143 is held within the shank 142*b* and is compressed between the heads 141*a* and 142*a* so as to exert an axial bias outward along line Z in FIG. 16.

A notch 146 is formed in the arcuate outer edge 62*a* opposite the notches 144 and 145. The notch 146 is formed between the left face 62*b* and the arcuate outer edge 62*a* and extends into the tang 62 from the left face 62*b* to a generally intermediate location between the left and right faces 62*b* and 62*c*. The notch 146 is rectangular and corresponds to the lug 141*d* so as to receive the lug 141*d* snugly.

In operation, when the blade 51 is in the open position, the first and second bolts 141 and 142 interlock with the tang 62 to lock the blade 51 in the open position. The spring 143 biases the first and second bolts outward along line Z so that the lug 141*d* is biased into an interference fit with the notch 144 and so that the lug 142*d* is biased into an interference fit with the notch 145. In this way, the bolt locking assembly 140 is in a locked configuration and the blade 51 is prevented from rotating from the open position to the closed position.

To move the blade 51 from the open position to the closed position, the bolt locking assembly 140 must be moved from the locked configuration to the unlocked configuration. One having ordinary skill in the art will appreciate that the steps involved in moving the bolt locking assembly 110 from the locked configuration to the unlocked configuration, as described above, are generally the same as those for moving the bolt locking assembly 140 from the locked configuration to the unlocked configuration. When the bolt locking assembly 140 is in the unlocked configuration and the blade 51 is in the open condition, the lugs 141*d* and 142*d* are retracted out of the notches 144 and 145, respectively, and are just off the left and right faces 62*b* and 62*c*, respectively, of the tang 62 so that the blade 51 may be moved from the open condition to the closed position. With the blade 51 moved into the closed position, the first and second bolts 141 and 142 are released from the user's fingers, and the spring 143 biases the first and second bolts 141 and 142 apart. The lug 141*d* on the first bolt 141 is received in the notch 146, and the lug 142*d* is received in contact against the right face 62*c*, defining a locked configuration of the bolt locking assembly 140 when the blade is in the closed position. One having skill in the art will understand that this arrangement could be reversed or that both lugs 141*d* and 142*d* could be received in notch 146 and another notch formed proximate to notch 146.

Figure 18:
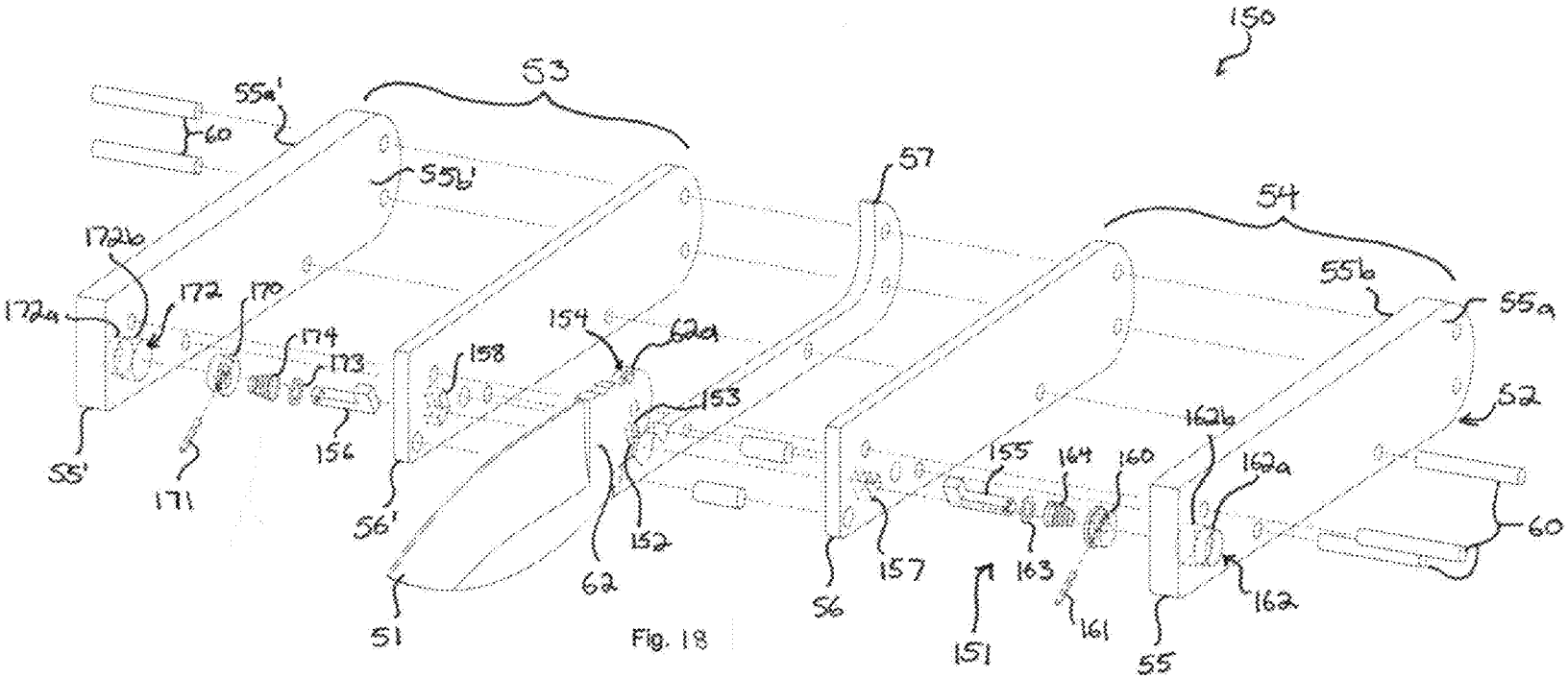
FIG. 18 is an exploded perspective view of the blade and handle assembly of FIG. 1 and an alternate embodiment of a bolt locking assembly.

Turning now to FIG. 18, another embodiment according to the present invention is illustrated and identified as a knife 150. The knife 150 includes features identical to that of the knife 50, as indicated with common reference numbers. However, the knife 150 carries a different bolt locking assembly 151, and the tang 62 is formed with different notches 152, 153, and 154.

The bolt locking assembly 151 includes a first bolt 155 carried in the right handle portion 54 and a second bolt 156 carried in the left handle portion 53. The first and second bolts 155 and 156 are carried in offset, elbow-shaped bores 157 and 158 for reciprocation. The bores 157 and 158 define a common channel through liners 56 and 56' in which both bolts 155 and 156 reciprocate in sliding contact side-by-side, against and alongside each other.

Figure 19:
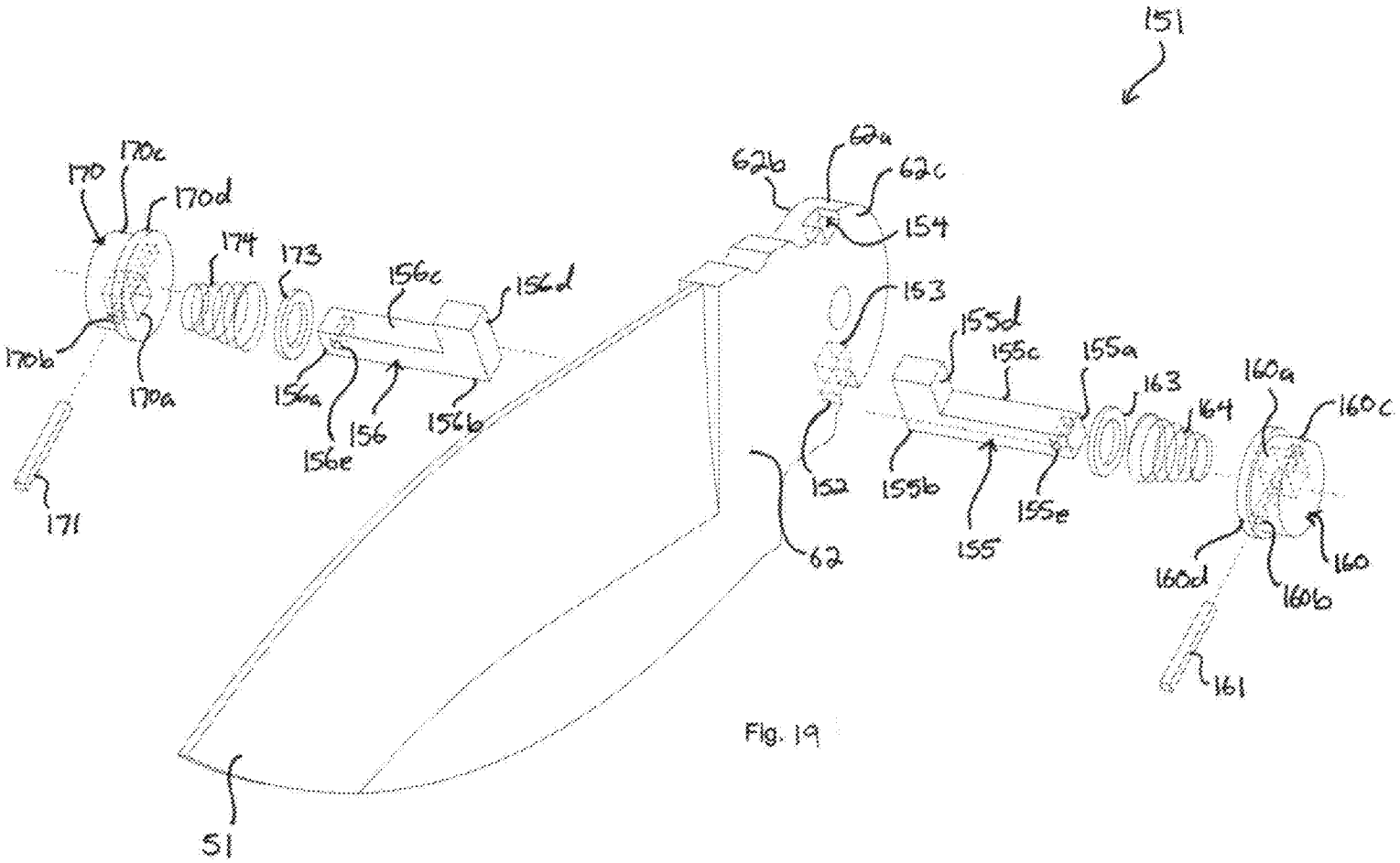
FIG. 19 is an isolated, exploded view of the blade and bolt locking assembly of FIG. 18.

With reference now to FIG. 19, which shows the bolt locking assembly 151 in greater detail, the first bolt 155 has a proximal end 155*a*, an opposed distal end 155*b*, a prismatic shank 155*c* extending between the proximal and distal ends 155*a* and 155*b*, and an upstanding lug 155*d* at the distal end 155*b*. A cylindrical button 160 is fixed to the proximal end 155*a* of the first bolt 155. The button 160 is formed with a prismatic recess 160*a* for receiving the proximal end 155*a* of the first bolt 155 and with a bore 160*b* extending from an annular sidewall 160*c* of the button 160 through the button 160 into the recess 160*a*. The proximal end 155*a* of the first bolt 155 is formed with a transverse bore 155*e* entirely through the first bolt 155, and when the proximal end 155*a* of the first bolt 155 is received in the recess 160*a*, the bores 160*b* and 155*e* are aligned and a pin 161 is frictionally fit in the bores 160*b* and 155*e* to secure the button 160 on the first bolt 155.

Referring briefly back to FIG. 18, the button 160 is received in a socket 162 formed through the handle 55. The socket 162 has a first bore 162*a* extending into the handle 55 from the outer surface 55*a*, and a larger diameter, co-axial second bore 162*b* extending into the handle 55 from the inner surface 55*b*. The button 160 is received in the socket 162 and has an inner annular flange 160*d* which corresponds in diameter to the second bore 162*b*. With the button 160 fit in the socket 162, the button 160 is flush with the outer surface 55*a* of the handle 55 so that the button 160 is available to be depressed by the user. The button 160 is limited from moving out of the socket 162 by the interaction of the flange 160*d* with the smaller-diameter first bore 162*a*.

With continuing reference back to FIG. 18, a washer 163 and a conical spring 164 are applied on the shank 155*c* and located in the second bore 162*b* between the button 160 and the liner 56. The spring 164, compressed against the washer 163 which is against the liner 56, urges the button 160 outwardly into the handle 55 and the first bolt 155 outwardly so as to locate the lug 155*d* in an interference position with the tang 62. The lug 155*d* is received in the notch 153. Now returning back to FIG. 19, the notch 153 is formed on the tang 62 between the left face 62*b* and the arcuate outer edge 62*a*, extends into the tang 62 to a location generally intermediate between the left and right faces 62*b* and 62*c*, and is sized and shaped to receive the lug 155*d* on the distal end 155*b* of the first bolt 155. With the spring 164 biasing the lug 155*d* into the notch 153, the tang 62 is locked and the blade 51 is prevented from rotating.

With continuing reference to FIG. 19, the second bolt 156 has a proximal end 156*a*, an opposed distal end 156*b*, a prismatic shank 156*c* extending between the proximal and distal ends 156*a* and 156*b*, and an upstanding lug 156*d* at the distal end 156*b*. A cylindrical button 170 is fixed to the proximal end 156*a* of the second bolt 156. The button 170 is formed with a prismatic recess 170*a* for receiving the proximal end 156*a* of the second bolt 156 and a bore 170*b* extending from an annular sidewall 170*c* of the button 170 through the button 170 into the recess 170*a*. The proximal end 156*a* of the second bolt 156 is formed with a transverse bore 156*e* entirely through the second bolt 156, and when the proximal end 156*a* of the second bolt 156 is received in the recess 170*a*, the bores 170*b* and 156*e* are aligned and a pin 171 is frictionally fit in the bores 170*b* and 156*e* to secure the button 170 on the second bolt 156.

Referring briefly back to FIG. 18, the button 170 is received in a socket 172 formed through the handle 55'. The socket 172 has a first bore 172*a* extending into the handle 55' from the outer surface 55*a*', and a larger diameter, co-axial second bore 172*b* extending into the handle 55' from the inner surface 55*b*'. The button 170 is received in the socket 172 and has an inner annular flange 170*d* which corresponds in diameter to the second bore 172*b*. With the button 170 fit in the socket 172, the button 170 is flush with the outer surface 55*a*' of the handle 55' so that the button 170 is available to be depressed by the user. The button 170 is limited from moving out of the socket 172 by the interaction of the flange 170*d* with the smaller-diameter first bore 172*a*.

A washer 173 and a conical spring 174 are applied on the shank 156*c* and located in the second bore 172*b* between the button 170 and the liner 56'. The spring 174, compressed against the washer 173 which is against the liner 56', urges the button 170 outwardly into the handle 55' and the second bolt 156 outwardly so as to locate the lug 156*d* in an interference position with the tang 62. The lug 156*d* is received in the notch 152. The notch 152 is formed on the tang 62 between the right face 62*c* and the arcuate outer edge 62*a*, extends into the tang 62 to a location generally intermediate between the left and right faces 62*b* and 62*c*, and is sized and shaped to receive the lug 156*d* on the distal end 156*b* of the second bolt 156. With the spring 174 biasing the lug 156*d* into the notch 152, the tang 62 is locked and the blade 51 is prevented from rotating.

With the blade 51 in the open position and the first and second bolts 155 and 156 urged outward so as to locate the lugs 155*d* and 156*d* in the notches 153 and 152, respectively, the blade 51 is locked and the bolt locking assembly 151 is arranged in a locked configuration preventing pivotal movement of the blade 51 from the open to the closed position. To move the blade 51 from the open position to the closed position, the user need only depress, as by the user's fingers, each of the buttons 160 and 170 inwardly, overcoming the spring force of the springs 164 and 174, so as to move the lugs 155*d* and 156*d* out of the notches 153 and 152, respectively, so that the lugs 155*d* and 156*d* are moved out of the interference position with tang 62. While the buttons 160 and 170 are depressed, the blade is pivoted into the closed position. In this position, the buttons 160 and 170 are released, and the lug 156*d* is urged, by the spring 174, into the notch 154. The notch 154 is formed on the tang 62 between the right face 62*c* and the arcuate outer edge 62*a*, extends into the tang 62 to a location generally intermediate between the left and right faces 62*b* and 62*c*, and is sized and shaped to receive the lug 156*d* on the distal end 156*b* of the second bolt 156. One having skill in the art will understand that a second notch could be formed proximate to the notch 154 for receiving the lug 155*d* when the blade 51 is in the closed position, or that the notch 154 could be formed on the left face 62*b* and receive the lug 155*d*. In the embodiment described above, the blade 51 is secured in a closed position and the bolt locking assembly 151 is in a locked configuration with respect to the closed position of the blade 51.

Figure 20:
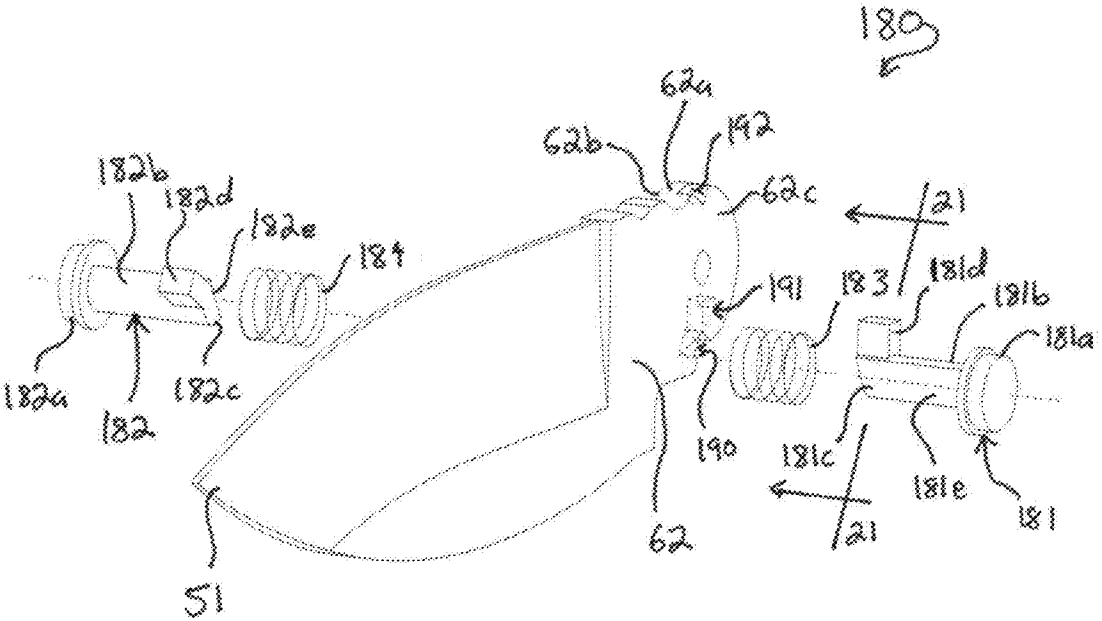
FIG. 20 is an isolated, exploded perspective view of the blade of FIG. 1 and an alternate embodiment of a bolt locking assembly.

Attention is now directed to FIG. 20, which illustrates an alternate embodiment of a bolt locking assembly identified with the reference character 180. The bolt locking assembly 180 includes a first bolt 181, a second bolt 182, and two linear compression springs 183 and 184 compressed between the first and second bolts 181 and 182.

The first bolt 181 has an enlarged head 181*a*, a semi-cylindrical shank 181*b* extending from the head 181*a* and terminating at an end 181*c*, and an upstanding lug 181*d* formed on the shank 181*b* at the end 181*c*. The lug 181*d* is a projection from a surface of the shank 181*b* and projects radially outward from the shank 181*b*.

The second bolt 182 has an enlarged head 182*a*, a semi-cylindrical shank 182*b* extending from the head 182*a* and terminating at an end 182*c*, and an upstanding lug 182*d* formed on the shank 182*b* at the end 182*c*. The lug 182*d* is a projection from a surface of the shank 182*b* and projects radially outward from the shank 182*b*.

Figure 21:
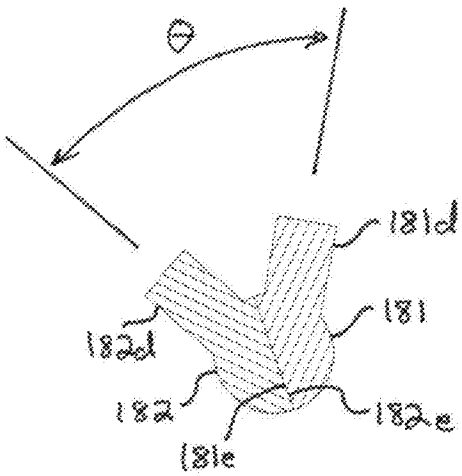
FIG. 21 is a section view of the bolt locking assembly of FIG. 20 taken along the line 21-21 in FIG. 20.

The first and second bolts 181 and 182 are carried for reciprocation past each other in the handle assembly 52 (not shown). The shanks 181*b* and 182*b* of the first and second bolts 181 and 182 are each formed with flat, inner faces 181*e* and 182*e*, respectively. The inner faces 181*e* and 182*e* are parallel and aligned with each other, so that during reciprocation of the first and second bolts 181 and 182, the inner faces 181*e* and 182*e* are received in sliding contact against and along each other. As seen in FIG. 21, the lugs 181*d* and 182*d* extend radially outward along respective axes, respectively, and are radially offset by an amount θ, which is preferably 40 degrees but could be another amount as will be understood by one having ordinary skill in the art. With reference back to FIG. 20, the spring 183 is located between the head 181*a* of the first bolt 181 and the liner 56 (not shown), and the spring 184 is located between the head 182*a* of the second bolt 182 and the liner 56' (not shown). The springs 183 and 184 urge the first and second bolts 181 and 182 axially outward.

The tang 62 is formed with structure to engage with the first and second bolts 181 and 182. The tang 62 includes notches 190, 191, and 192 formed along the arcuate outer edge 62*a*. The notches 190 and 191 are directed toward the spacer 57 when the blade 51 is in the open position, and the notch 192 is directed toward the spacer 57 when the blade 51 is in the closed position. The notches 190, 191, and 192 are radially spaced apart about the arcuate outer edge 62*a*, and are shaped to receive the lug 182*d*, 181*d*, and 182*d*, respectively.

With the blade 51 in the open position, the spring 183 urges the first bolt 181 axially outward so as to locate the lug 181*d* in the notch 191 in an interference fit. Likewise, the spring 184 urges the second bolt 182 axially outward so as to locate the lug 182*d* in the notch 190 in an interference fit. In this way, the lugs 181*d* and 182*d* engage the tang 62 to prevent the blade 51 from pivoting, defining a locked configuration on the bolt locking assembly 180. To move the blade 51 from the open position to the closed position, the heads 181*a* and 182*a* are depressed, as by a user's fingers, to move the lugs 181*d* and 182*d* out of the notches 191 and 190, respectively. In this way, the blade 51 is free to pivot from the open position to the closed position, and the heads 181*a* and 182*a* are then released, allowing the springs 183 and 184 to bias the first and second bolts 181 and 182 axially outward, so that the lug 182*d* is received in the notch 192. As one having skill in the art will readily appreciate, the blade 51 is locked in the closed position by the second bolt 182 alone, but could be locked by the first bolt 181 alone, or by both the first and second bolts 181 and 182 with the addition of additional notches to the tang 62 as described above with reference to other embodiments.

Figure 22:
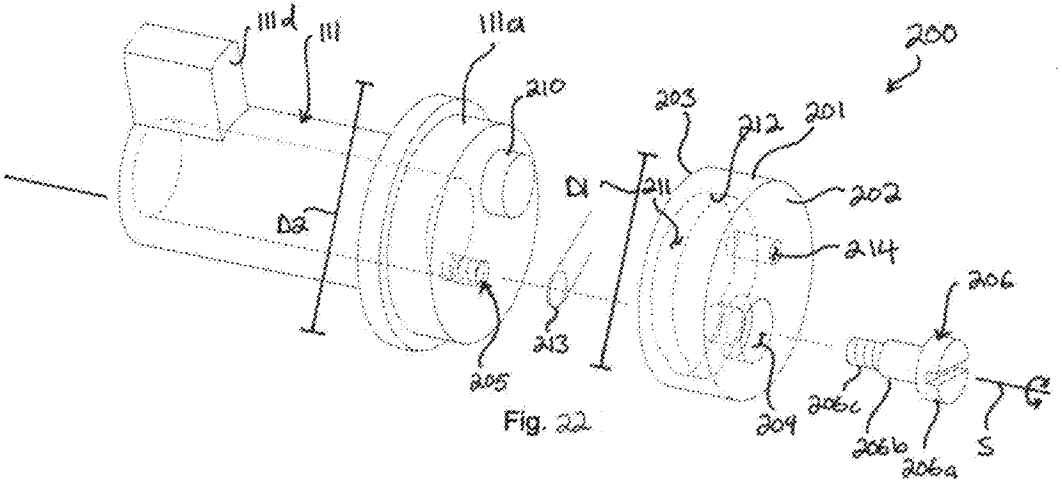
FIG. 22 is an isolated, exploded perspective view of the cap assembly of FIG. 1.

With reference now to FIG. 22, a cap assembly 200 is illustrated. The cap assembly 200 is useful for preventing the accidental depression of the first and second bolts 111 and 112 out of the locked configuration of the bolt locking assembly 110. The cap assembly 200 is shown in FIG. 22 configured over the first bolt 111, but it should be understood that the cap assembly 200 is similarly configured over the second bolt 112, the first bolt 131, and the second bolt 132.

The cap assembly 200 includes a cap 201 mounted for pivotal movement to the head 111*a* of the first bolt 111 about an axis S between a locked position and an operative position. The cap 201 is cylindrical and has a diameter D1. The cap 201 includes an outer face 202, an opposed inner face 203 held against the head 111*a*, and a bore 204 extending through the cap 201 from the outer face 202 to the inner face 203 at axis S. A corresponding threaded bore 205 aligned with the bore 204 extends into the head 111*a* of the first bolt 111. A screw 206 is set into the bore 204, through the cap 201, and is threadably engaged with the threaded bore 205. The screw 206 has an enlarged head 206*a* and a threadless shank 206*b* extending from the head 206*a* and terminating in a threaded portion 206*c*. The enlarged head 206*a* is seated in the bore 204, preventing axial movement of the cap 201 off the head 111*a* of the first bolt 111, the threaded portion 206*c* is threadably engaged with the threaded bore 205 in the first bolt 111, and the cap 201 encircles the threadless shank 206*b* so that the cap 201 may pivot about the axis S and the screw 206 installed along axis S.

Figure 23:
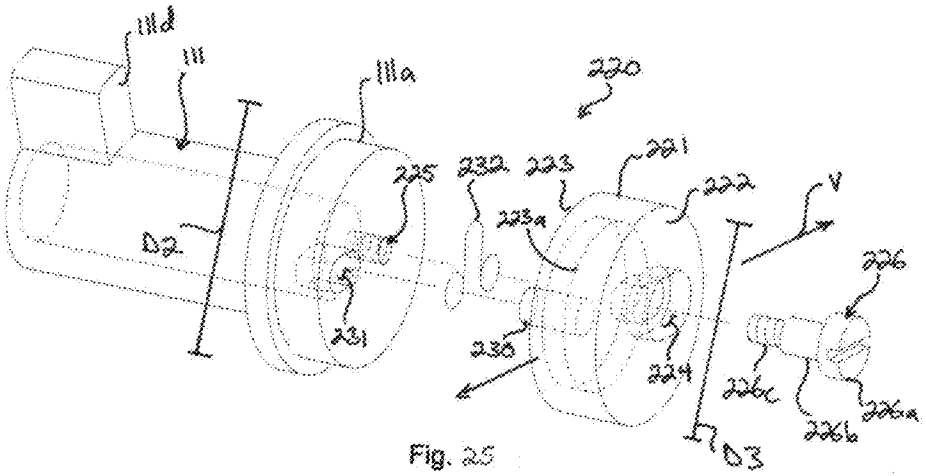
FIGS. 23A and 23B are isolated, perspective views of the cap assembly and handle assembly of FIG. 1 showing the cap assembly in a locked position and an operative position, respectively, over the bolt locking assembly.
Figure 23A:
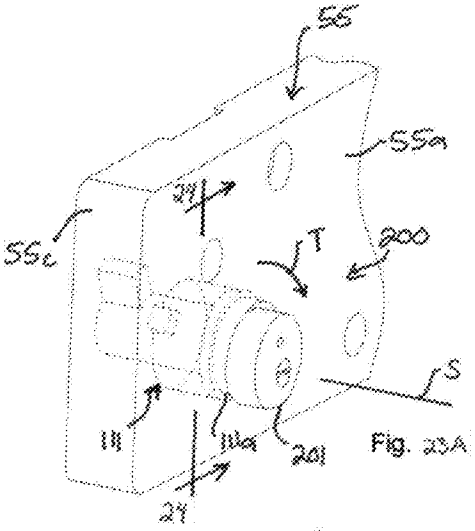

With reference now to FIG. 22 as well as to the sequence of FIGS. 23A, 23B, and 24A-24C, the cap 201 moves between the locked and operative positions. An axially-projecting post 210 is carried on the head 111*a* of the first bolt 111 extending out toward the cap 201. The inner face 203 of the cap is formed with a depression 211 for receiving the post 210. The depression has an inner sidewall 212 extending around the cap 201. A torsional spring 213 secured about the threadless shank 206*b* has outwardly extending fingers in contact with the post 210 and the inner sidewall 212, such that the spring 213 is compressed between the post 210 and the sidewall 212. The spring 213 biases the cap 201 off the head 111*a* until the inner sidewall 212 contacts the post 210, limiting further movement of the cap 201 with respect to the head 111*a*. When the first bolt 111 is in the locked configuration, the head 111*a* is located flush at the outer surface 55*a* of the handle 55, and the spring 213 biases the cap 201 into a locked position in which the cap 201 is offset from the head 111*a* of the first bolt 111, as shown in FIG. 23A, thus preventing depression of the first bolt 111. The head 111*a* has a diameter D2, and the diameter D1 of the cap 201 is equal to the diameter D2, so that when the cap 201 is offset from the head 111*a*, a portion of the inner face 203 is in contact with the outer surface 55*a* of the handle 55 and prevents axial translation of the first bolt 111 into the handle assembly 52 into the unlocked configuration.

Figure 23B:
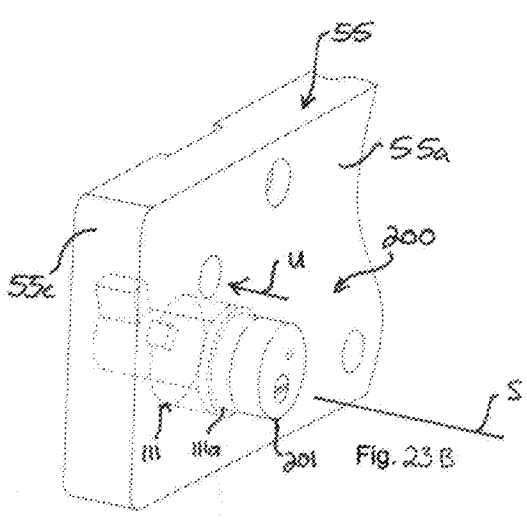

To move the cap assembly 200 from the locked position, shown in FIG. 23A and FIG. 24A, to the operative position, shown in FIG. 23B and FIG. 24B, in which the first bolt 111 may be depressed, the user need only apply force to the cap 201 about axis S in a direction opposite to that urged by the spring 213, as indicated by the curved line T in FIG. 23A, moving the cap 201 from an offset position to an aligned position with respect to the head 111*a* as shown in FIG. 23B and FIG. 24B. Curved line T lies in a plane normal to the axis S and to the axis J along which the first and second bolts 111 and 112 reciprocate. Because the diameters D1 and D2 of the cap 201 and head 111*a* are equal, the cap 201 may now pass through the second bore 115 so that the first bolt 111 may be depressed along line U toward the unlocked configuration of the bolt locking assembly 110 to move the blade 51, as shown in FIG. 24C. The cap 201 is depressed until the outer face 202 of the cap 201 is flush with the outer surface 55*a* of the handle 55.

After the user has moved the blade 51 into the desired position, the user merely releases the first bolt 111 and the cap 201, and the spring 113 urges the first bolt 111 back into the locked configuration of the bolt locking assembly 110 with the head 111*a* of the first bolt 111 located at the outer surface 55*a* of the handle 55, and the spring 213 urges the cap 201 back into the offset position. In this manner, the knife 50 can be operated without accidentally moving the bolt locking assembly 110. An access bore 214 is formed through the cap 201 from the outer face 202 to the inner face 203 to provide access to the spring 213 with a small tool such as a pin or paper clip so as to aid in assembly of the cap assembly 200 on the first bolt 111.

A cap assembly 220 in an alternate embodiment from that of the cap assembly 200 is shown in FIG. 25. The cap assembly 220 is useful for preventing the accidental depression of the first and second bolts 111 and 112 out of the locked configuration of the bolt locking assembly 110. The cap assembly 220 is shown in FIG. 25 configured over the first bolt 111, but it should be understood that the cap assembly 220 is similarly configured over the second bolt 112, the first bolt 131, and the second bolt 132.

The cap assembly 220 includes a cap 221 mounted for translational movement to the head 111*a* of the first bolt 111 along a line V between a locked position and an operative position. The cap 221 is cylindrical and has a diameter D3. The cap 221 includes an outer face 222, an opposed inner face 223 held against the head 111*a*, a recessed face 223*a* inboard of the inner face 223, and an elongate bore 224 extending through the cap 221 from the outer face 222 to the inner face 223. A corresponding threaded bore 225 aligned with the bore 224 extends into the head 111*a* of the first bolt 111. A screw 226 is set into the bore 224, through the cap 221, and is threadably engaged with the threaded bore 225. The screw 226 has an enlarged head 226*a* and a threadless shank 226*b* extending from the head 226*a* and terminating in a threaded portion 226*c*. The enlarged head 226*a* is seated in the bore 224 for reciprocal movement of the cap 221 along line V with respect to the first bolt 111, preventing axial movement of the cap 221 off the head 111*a* of the first bolt 111, and the threaded portion 226*c* is threadably engaged with the threaded bore 225 in the first bolt 111. Line V is aligned parallel to the outer surface 55*a* of the handle 55 and is normal to the axis J along which the first and second bolts 111 and 112 reciprocate.

Figure 26A:
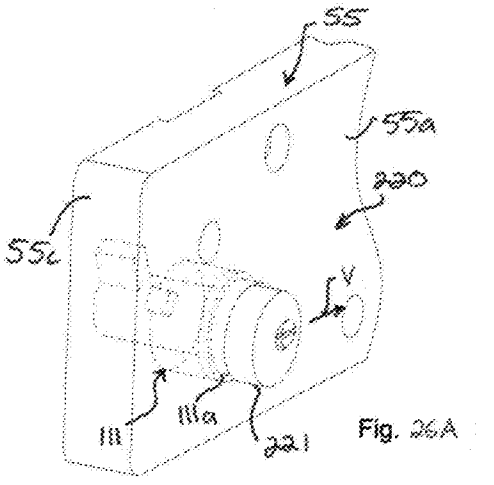
FIGS. 26A and 26B are isolated, perspective views of the cap assembly of FIG. 25 and the handle assembly of FIG. 1 showing the cap assembly in a locked position and an operative position, respectively, with respect to the bolt locking assembly.
Figure 26B:
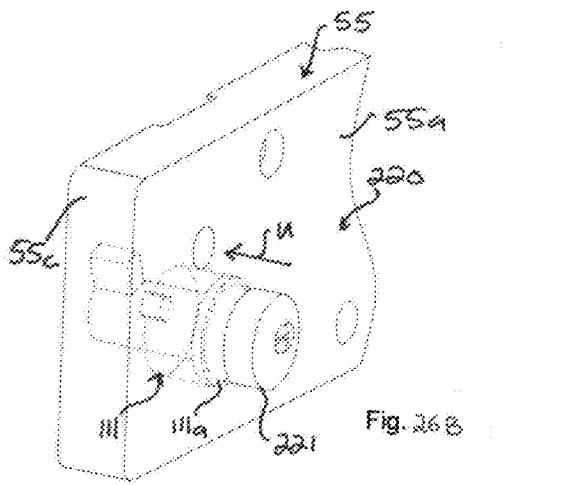
Figure 29C:
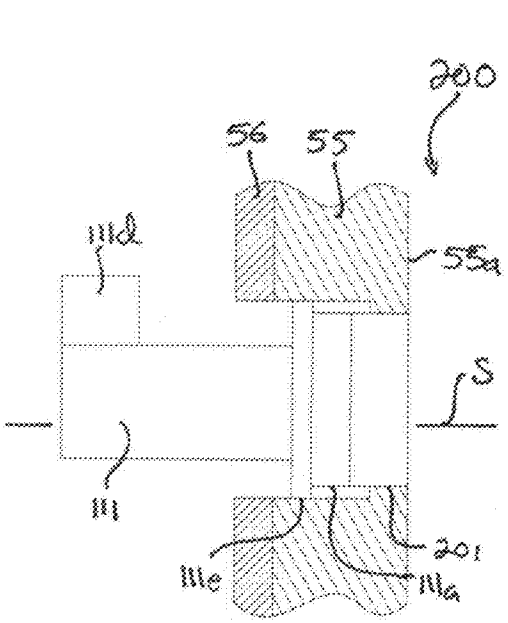
Figure 29B:
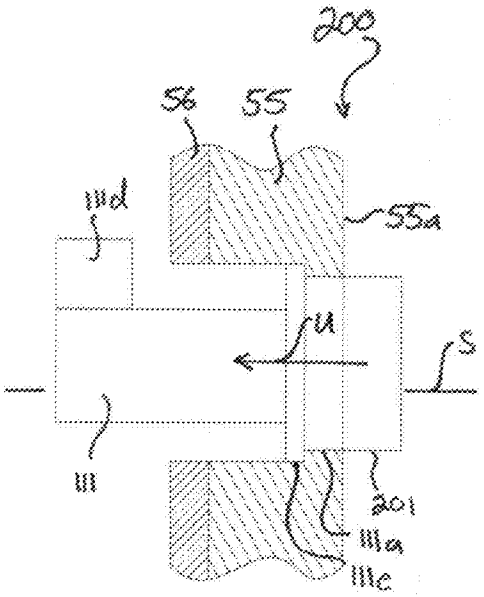
Figure 29A:
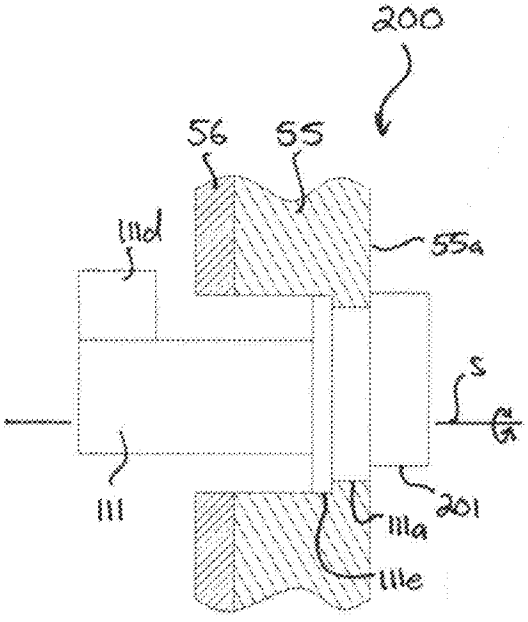

With reference now to FIG. 25 as well as the sequence of FIGS. 26A and 26B, the cap 221 translates between the locked and operative positions. An axially-projecting post 230 is carried on the recessed inner face 223*a* of the cap 221 and extends out toward the head 111*a*. A slot 231 extends into the head 111*a* opposite the post 230 and is aligned with the elongate bore 224 along line V. The slot 231 is sized to receive the post 230 and allow the post 230 to reciprocate along line V within the slot 231. A spring 232 is secured on the threadless shank 226*b* and on the post 230. When the first bolt 111 is in the locked configuration with the head 111*a* located flush at the outer surface 55*a* of the handle 55, the spring 232 biases the cap 221 into the locked position in which the cap 221 is offset from the head 111*a* of the first bolt 111, as shown in FIG. 26A, thus preventing depression of the first bolt 111. The diameter D3 of the cap 221 is equal to the diameter D2, so that when the cap 221 is offset from the head 111*a*, a portion of the inner face 223 is in contact with the outer surface 55*a* of the handle 55 and prevents axial movement of the first bolt 111 into the handle assembly 52 into the unlocked configuration.

To move the cap assembly 220 from the locked position, shown in FIG. 26A, to the operative position, shown in FIG. 26B, in which the first bolt 111 may be depressed, the user need only apply force to the cap 221 in a direction along the arrowed line V in FIG. 26A opposite to the bias urged by the spring 232, moving the cap 221 from an offset position to an aligned position with respect to the head 111*a* as shown in FIG. 26B. Because the diameters D3 and D2 of the cap 221 and head 111*a* are equal, the cap 221 may now pass through the second bore 115 so that the first bolt 111 may be depressed along line U toward the unlocked configuration of the bolt locking assembly 110. The cap 221 is depressed until the outer face 222 of the cap 221 is flush with the outer surface 55*a* of the handle 55.

After the user has moved the blade 51 into the desired open or closed position, the user merely releases the first bolt 111 and the cap 221, and the first bolt 111 is urged back into the locked configuration of the bolt locking assembly 110 with the head 111*a* of the first bolt located at the outer surface 55*a* of the handle 55, and the spring 232 urges the cap 221 back into the offset position. In this manner, the knife 50 can be operated without accidentally moving the bolt locking assembly 110 into the unlocked configuration.

The present invention is described above with reference to a preferred embodiment. However, those skilled in the art will recognize that changes and modifications may be made in the described embodiment without departing from the nature and scope of the present invention.

One having skill in the art will recognize that changes and modifications may be made in the above described embodiment without departing from the nature and scope of the present invention. Various further changes and modifications to the embodiments disclosed herein chosen for purposes of illustration will readily occur to those skilled in the art. To the extend that such modifications and variations do not depart from the spirit of the invention, they are intended to be included within the scope thereof.

Having fully described the invention in such clear and concise terms as to enable one having skill in the art to understand and practice the same, the invention claimed is:

The invention claimed is:

1. A folding knife comprising:

a handle assembly including opposed first and second handle portions, a channel defined between the first and second handle portions, and first and second bores formed through the first and second handle portions, respectively;

a blade including a tang, the tang having an outer edge formed with spaced-apart notches and being mounted to the handle assembly proximate to the first and second bores for pivotal movement of the blade between an open position and a closed position in which the blade is received within the channel;

first and second bolts extending into the handle assembly and carried for reciprocation in the first and second bores, respectively, between unlocked and locked configurations;

first and second lugs formed on the first and second bolts, respectively, and aligned with the notches formed along the outer edge of the tang;

a slot formed in the second bolt for receiving the first lug of the first bolt during reciprocation of the first and second bolts;

in the unlocked configuration of the first and second bolts, the first and second bolts are depressed into the handle assembly, locating the first and second lugs beyond the tang; and in the locked configuration of the first and second bolts, the first and second bolts are arranged so as to locate the first and second lugs in interference positions with the tang, preventing pivotal movement of the blade.

2. The folding knife of claim 1, further comprising biasing means biasing the first and second bolts into the locked configuration.

3. The folding knife of claim 1, wherein the first and second bores are coaxial and the first and second bolts are coaxial.

4. The folding knife of claim 3, wherein the first bolt reciprocates within a bore in the second bolt.

5. The folding knife of claim 3, wherein the slot in the second bolt is radially offset from the second lug on the second bolt.

6. The folding knife of claim 3, wherein the first and second lugs have axes that are offset by a radial amount.

7. The folding knife of claim 3, wherein the first and second lugs are aligned along a common axis.

8. The folding knife of claim 7, wherein the first and second lugs are circumferentially offset on the first and second bolts, respectively, and have axes that are parallel.

9. The folding knife of claim 3, wherein the slot in the second bolt extends through the second lug on the second bolt.

10. A folding knife comprising:

a handle assembly including opposed first and second handle portions, a channel defined between the first and second handle portions, and first and second bores formed through the first and second handle portions, respectively;

a blade having a tang mounted to the handle assembly for pivotal movement of the blade between an open position and a closed position in which the blade is received in the channel;

a bolt locking assembly carried by the handle assembly for movement between a locked configuration and an unlocked configuration, the bolt locking assembly including first and second bolts, each extending into the handle assembly and carried for reciprocation in both the first and second bores;

lugs formed on each of the first and second bolts;

in the open position of the blade and the locked configuration of the bolt locking assembly, the first and second bolts are in an interference position with the tang so as to place the lugs on the first and second bolts in contact with the tang; and in the closed position of the blade and the locked configuration of the bolt locking assembly, at least one of the first and second bolts is in an interference position with the tang so as to place the lug on the at least one of the first and second bolts in contact with the tang.

11. The folding knife of claim 10, further comprising biasing means applied to the first and second bolts to bias the bolt locking assembly into the locked configuration.

12. The folding knife of claim 10, wherein the first and second bolts have prismatic shanks that are offset with respect to each other in the handle assembly.

13. The folding knife of claim 10, wherein the first and second bolts are semi-cylindrical and reciprocate in sliding contact against each other.

14. The folding knife of claim 10, further comprising:

radially spaced-apart notches formed on an outer edge of the tang; and in the unlocked configuration of the locking assembly, the lugs on the first and second bolts are spaced apart and define a groove between the lugs in which the tang is received during pivotal movement of the blade between the deployed and closed positions.

15. The folding knife of claim 10, further comprising a slot formed in the second bolt for receiving the first lug of the first bolt during reciprocation of the first and second bolts.

16. The folding knife of claim 15, wherein the first and second bores are coaxial and the first and second bolts are coaxial.

17. The folding knife of claim 16, wherein the first bolt reciprocates within a bore in the second bolt.

18. The folding knife of claim 16, wherein the slot formed in the second bolt is radially offset from the second lug.

19. The folding knife of claim 16, wherein the slot formed in the second bolt extends through the second lug.

20. A folding knife comprising:

a handle assembly including opposed first and second handle portions, a channel defined between the first and second handle portions, and first and second bores formed in the first and second handle portions, respectively;

a blade having a tang mounted to the handle assembly for pivotal movement of the blade between an open position and a closed position in which the blade is received in the channel;

a bolt locking assembly carried by the handle assembly for movement between a locked configuration and an unlocked configuration, the bolt locking assembly including first and second bolts extending into the handle assembly in the first and second bores, respectively;

lugs formed on each of the first and second bolts;

in the open position of the blade and the locked configuration of the bolt locking assembly, the first and second bolts are in an interference position with the tang so as to place the lugs on the first and second bolts in contact with the tang; and in the closed position of the blade and the locked configuration of the bolt locking assembly, at least one of the first and second bolts is in an interference position with the tang so as to place the lug on the at least one of the first and second bolts in contact with the tang;

wherein the first and second bolts are carried for reciprocation in each of the first and second bores, the first bolt sliding alongside the second bolt.

* * * * *